US006212803B1

(12) United States Patent
Key

(10) Patent No.: US 6,212,803 B1
(45) **Date of Patent: *Apr. 10, 2001**

(54) ROTATABLE LABEL SYSTEM ON A DRINKING VESSEL AND METHOD FOR CONSTRUCTING SAME

(75) Inventor: Stephen M. Key, Oakdale, CA (US)

(73) Assignee: Stephen Key Design, LLC, Oakdale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/327,151

(22) Filed: Jun. 7, 1999

(51) Int. Cl.[7] ..... G09F 3/00

(52) U.S. Cl. ..... 40/324; 40/506; 206/901; 215/252

(58) Field of Search ..... 40/306, 310, 324; 206/901; 215/252, 256

(56) References Cited

U.S. PATENT DOCUMENTS

| | | | |
|---|---|---|---|
| 736,035 | 8/1903 | Stevenson . | |
| 1,064,576 | 6/1913 | Washburn . | |
| 1,312,611 | 8/1919 | Chess . | |
| 1,334,031 | 3/1920 | Hahn . | |
| 1,387,625 | 8/1921 | Stein . | |
| 1,486,313 | 3/1924 | Van Antwerp . | |
| 2,013,616 | 9/1935 | Rettenmeyer | 220/1 |
| 2,129,364 | 9/1938 | Simons et al. | 283/8 |
| 2,441,607 | 5/1948 | Walls | 46/13 |
| 2,468,000 | 4/1949 | Taylor | 273/143 |
| 2,504,076 | 4/1950 | Lindblom | 40/68 |
| 2,706,464 | 4/1955 | North | 116/121 |
| 2,739,564 | 3/1956 | North | 116/121 |
| 2,844,893 | 7/1958 | Keller | 40/4 |
| 2,860,431 | 11/1958 | Barnum | 40/61 |
| 2,931,657 | 4/1960 | Lewis | 273/155 |
| 2,935,814 | 5/1960 | Freeze | 46/35 |
| 2,971,283 | 2/1961 | Parker | 40/334 |
| 3,278,182 | 10/1966 | Lescher | 272/8 |
| 3,374,911 | 3/1968 | White | 215/8 |
| 3,488,880 | 1/1970 | Taylor | 46/24 |
| 3,542,229 | 11/1970 | Beyerlein et al. | 215/1 |
| 3,604,584 | 9/1971 | Shank | 215/12 R |
| 3,733,002 | 5/1973 | Fujio | 215/12 R |
| 3,960,713 | 6/1976 | Carey | 206/534 |
| 4,044,889 | 8/1977 | Orentreich et al. | 206/459 |
| 4,203,240 | 5/1980 | Goodwin | 40/310 |
| 4,381,615 | 5/1983 | Lonsmin | 40/334 |
| 4,405,045 | 9/1983 | Villa-Real | 206/534 |
| 4,505,497 | 3/1985 | Katzman | 283/81 |

(List continued on next page.)

FOREIGN PATENT DOCUMENTS

| | | | |
|---|---|---|---|
| 85214 | 3/1958 | (DK) . | |
| 0285514 | 10/1988 | (EP) | G09F/3/02 |
| 965522 | 9/1950 | (FR) . | |
| 1114750 | 4/1956 | (FR) . | |
| 1347102 | 11/1963 | (FR) . | |
| 2460260 | 1/1981 | (FR) | B65D/25/36 |
| 2677786 | 12/1992 | (FR) | G09F/3/02 |
| 327286 | 7/1935 | (IT) . | |

*Primary Examiner*—Cassandra H. Davis
(74) *Attorney, Agent, or Firm*—Carr & Ferrell LLP; Susan Yee

(57) ABSTRACT

A rotatable label system includes a drinking vessel having indicia disposed on an exterior surface of the drinking vessel and a rotatable label formed from a heat-shrinkable shell or sheet arranged about the drinking vessel. The rotatable label has indicia disposed thereon and may include at least one transparent window through which co-located indicia disposed on the surface of the drinking vessel may be viewed. The rotatable label is rotatable relative to the drinking vessel about a vertical axis thereof to enable viewing of a selected subset of the indicia disposed on the drinking vessel. Surface features and contours of the drinking vessel maintain the rotatable label longitudinally upon the drinking vessel.

22 Claims, 21 Drawing Sheets

U.S. PATENT DOCUMENTS

| | | | |
|---|---|---|---|
| 4,567,681 | 2/1986 | Fumei | 40/310 |
| 4,658,974 | 4/1987 | Fujita et al. | 215/12 R |
| 4,724,973 | 2/1988 | Shah | 215/246 |
| 4,877,119 | 10/1989 | Hosking | 206/459 |
| 5,076,613 | 12/1991 | Kovacs | 283/106 |
| 5,154,448 | 10/1992 | Griffin et al. | 283/102 |
| 5,324,559 | 6/1994 | Brombacher | 428/40 |
| 5,342,093 | 8/1994 | Weernink | 285/81 |
| 5,403,636 | 4/1995 | Crum | 428/40 |
| 5,809,674 | 9/1998 | Key | 40/306 |
| 5,884,421 | 3/1999 | Key | 40/306 |

ROTATABLE LABEL SYSTEM ON A DRINKING VESSEL AND METHOD FOR CONSTRUCTING SAME

CROSS-REFERENCE TO RELATED PATENTS AND APPLICATIONS

The present application is related to and incorporates by reference the following patents and patent applications: U.S. Pat. No. 5,809,674 issued Sep. 22, 1998, for an invention entitled "Apparatus and Method for Increasing an Effective Information Carrying Surface Area on a Container"; U.S. Pat. No. 5,884,421 issued Mar. 23, 1999 entitled "Apparatus and Method for Constructing a Rotatable Label Device"; U.S. patent application Ser. No. 09/126,010 filed on Jul. 29, 1998 entitled "Rotating Label System and Method"; U.S. patent application Ser. No. 09/187,299 filed Nov. 5, 1998 entitled "Rotatable Label System and Method for Constructing the Same"; and U.S. patent application Ser. No. 09/247,245 filed Feb. 9, 1999 entitled "Rotatable Label System Including Tamper-Evident Feature and Method for Constructing Same."

BACKGROUND OF THE INVENTION

1. Field of the Invention

The present invention relates generally to labels and more particularly to a rotatable label system on a drinking vessel and method for constructing same.

2. Description of the Background Art

Many drinking vessels, such as the kind obtained in fast food restaurants or at sporting events, display information in the form of written indicia. The written indicia is typically arranged directly on the exterior surface of the vessel or on a label affixed around the vessel. This information may include the name of the restaurant, advertisements, promotions, and artwork.

A problem associated with conventional drinking vessels is that insufficient space is available on the exterior surface of the vessel to display all of the information a manufacturer desires to provide to a consumer. In order to accommodate all of the desired information on the exterior surface of the vessel, the manufacturer may reduce the size or typeface of some or all of the indicia. Furthermore, the indicia may be more closely spaced together. However, the reduction in size of text and/or graphics may adversely affect the visual appeal of the vessel, and may render some or all of the information illegible to the consumer.

To provide additional space for the presentation of information, it has been proposed that a rotatable outer label be positioned about the drinking vessel having an inner label or indicia imprinted on the vessel exterior surface. The outer label typically has a transparent portion, which when rotated relative to the vessel, allows for viewing of the inner label or exterior surface through the transparent portion. This construction permits information display on both the outer label and the inner label or vessel surface; thus increasing the display area.

Despite the advantages of having a rotatable outer label on a drinking vessel, it has been impractical to employ rotatable outer labels due to the difficulty of applying such a rotatable label to a vessel in an efficient and rapid manner. Conventionally, a label is attached to a vessel with an adhesive applied to either the label or the vessel. However, this manner of application yields a label that is fixed, and not rotatable, relative to the vessel. Consequently, there is a need for a system and method by which a rotatable label may be rapidly disposed about a drinking vessel.

SUMMARY OF THE INVENTION

The present invention overcomes or substantially alleviates problems associated with display of information on a prior art drinking vessel. In general, the present invention provides a drinking vessel having an inner label or written indicia disposed directly thereon and a rotatable outer label of heat-shrinkable material (referred to herein as "shrink-wrap" material) disposed about the exterior of the drinking vessel and conforming thereto.

The rotatable label may include at least one transparent window which, when rotated relative to the vessel about a central vertical axis thereof, allows selective viewing of co-located indicia arranged on the exterior of the vessel (either on an inner label affixed to the vessel or printed directly on the exterior surface of the vessel). Because indicia may be disposed both on the inner and rotatable labels, the manufacturer may advantageously provide a substantially increased amount of information to the user.

The present invention discloses various methods of constructing a rotatable label system on a drinking vessel. According to the preferred embodiment, a drinking vessel with written indicia disposed thereon is inverted. A shrink-wrap shell constituting the outer label is lowered about the inverted vessel. The longitudinal movement of the shell is hindered when the circumference of the drinking vessel equals that of the shell. Heat is then applied to the shell, causing the shell to conform to the surface features of the drinking vessel. The diameter of the shell, as well as the duration and conditions of the heat-shrinking process, are carefully controlled such that the resultant label does not adhere to the vessel and can be easily rotated relative to the vessel.

In certain embodiments of the invention, the vessel is shaped or provided with surface contours to inhibit vertical displacement of the shell. Furthermore, the shell may be adapted with a set of perforation lines, including at least one horizontally oriented perforation line extending circumferentially about the shell. The perforations define lines of weakening which enable a user to quickly and easily activate the rotatable label system.

Accordingly, the present invention provides a rotatable label system that may be efficiently constructed, and which permits written indicia disposed directly on a vessel exterior surface or on an inner label to be viewed through a transparent window of an outer rotatable label. Other advantages and features of the present invention will be apparent from the drawings and detailed description as set forth below.

DETAILED DESCRIPTION OF PREFERRED EMBODIMENTS

Figure 1:
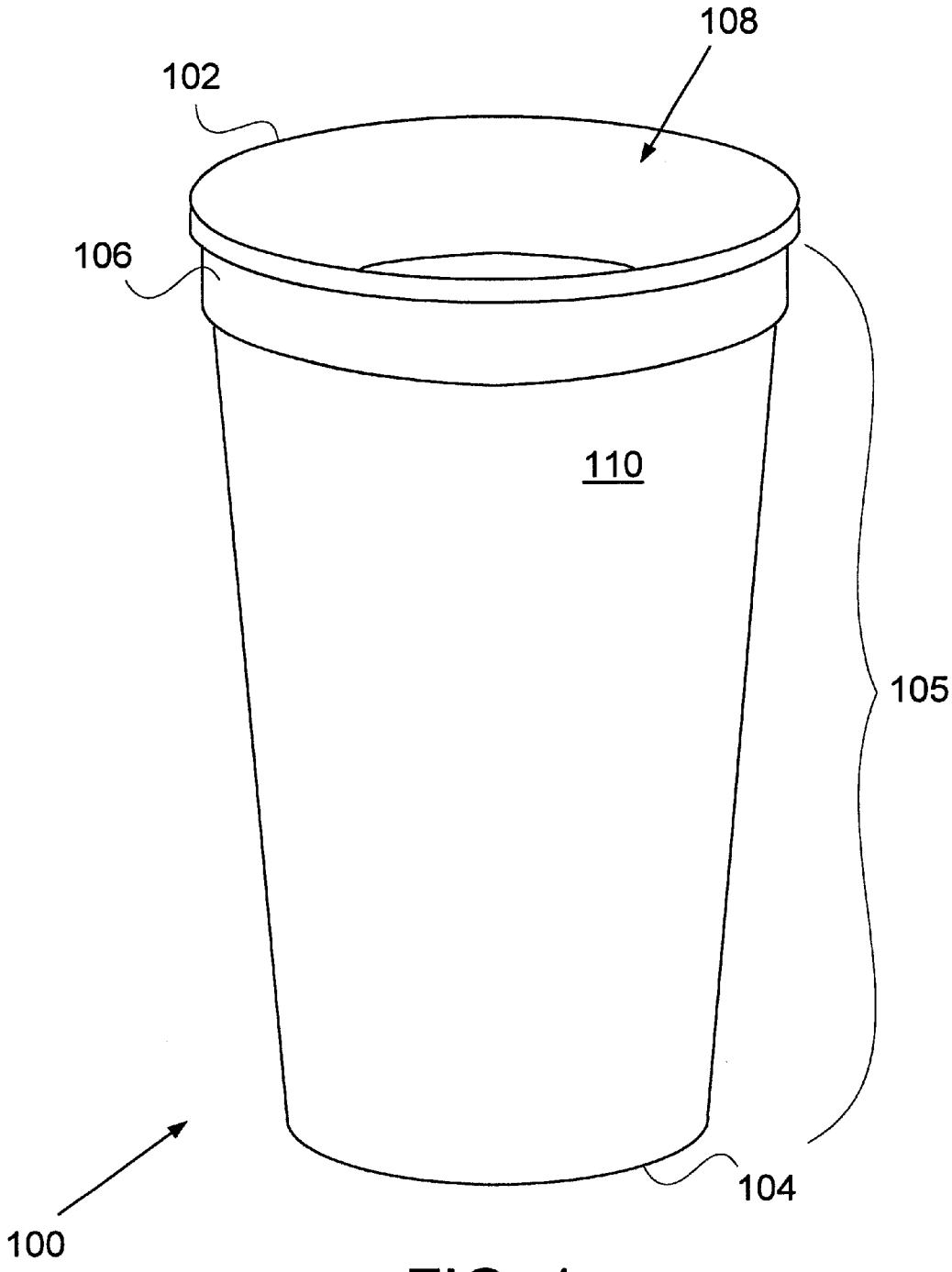
FIG. 1 (Prior Art)
FIG. 1 is a perspective view of a prior art drinking vessel.

FIG. 1 illustrates a conventional drinking vessel 100, which includes a top end 102 and a bottom end 104 and a tapered section 105 extending between the top and bottom ends 102 and 104. The drinking vessel 100 is formed in a generally frustro-conical shape, having a relatively narrow bottom end 104 which expands upwardly and outwardly to a relatively wide top end 102. A drinking rim 106 is located on the top end 102 and defines an opening 108 through which liquids may flow in and out of the vessel 100. The drinking vessel 100 may be formed from plastic, paper, or Styrofoam, although those skilled in the art will recognize other materials that may be employed. Furthermore, written indicia can be disposed directly on an exterior surface 110 of the vessel 100 or on a label (not shown) affixed to the vessel 100 exterior surface 110.

Figure 2A:
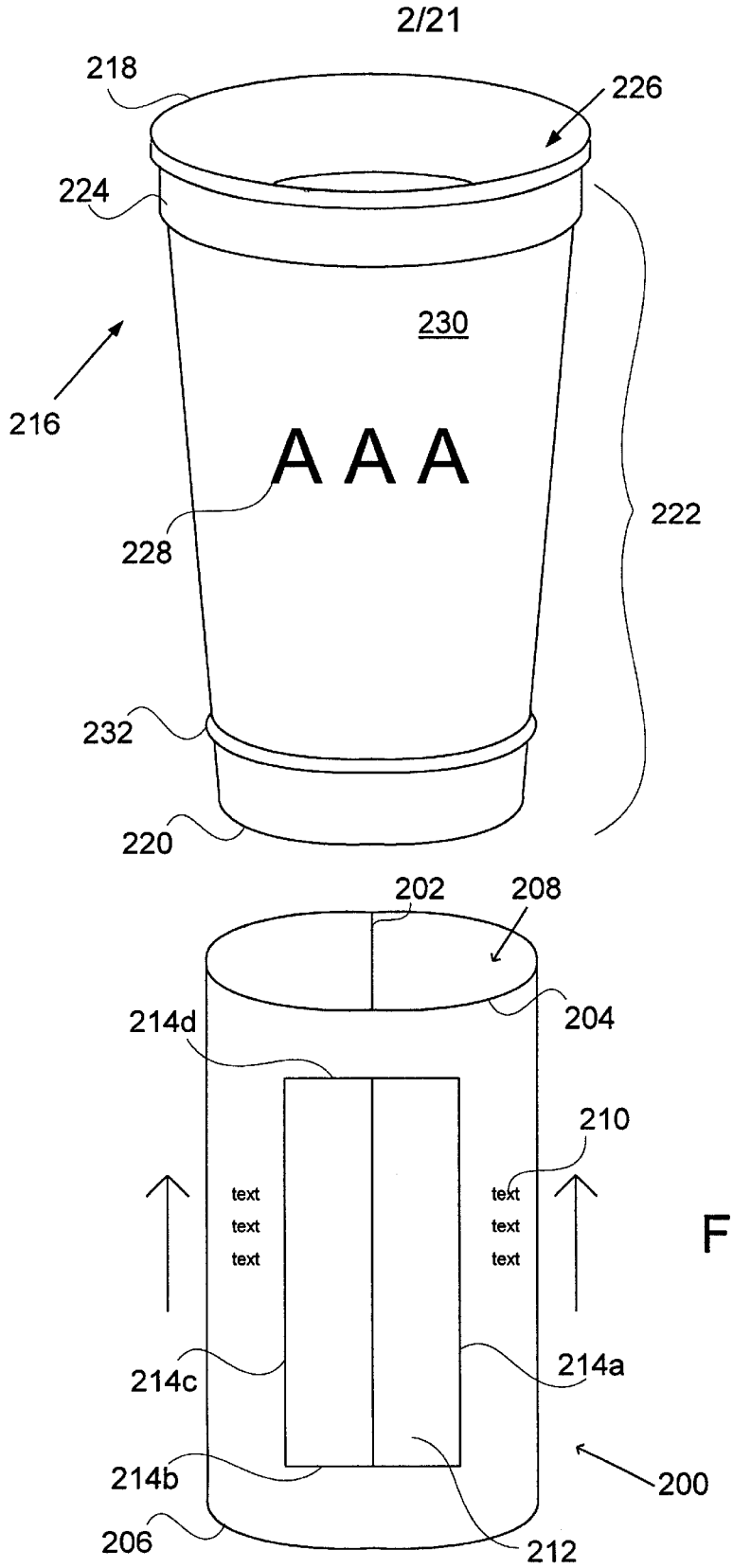
FIG. 2A is a front view of a rotatable label and drinking vessel prior to assembly.

FIG. 2A shows a rotatable label 200 and a drinking vessel 216, according to the present invention. The rotatable label 200 is preferably fabricated from a generally rectangular sheet of heat-shrinkable (shrinkwrap) material by thermal welding or otherwise joining the opposed edges of the sheet along a seam 202, resulting in a generally tubular shaped shell. This tubular shaped shell extends between a top edge 204 and a bottom edge 206 and defines a chamber 208 interiorly thereto. The shrinkwrap material may include polyvinyl chloride (PVC), polyethylene terephthalate, glycol modified (PETG), and biaxially oriented poly-propylene (BOPP).

The rotatable label 200 is substantially non-transparent and has arranged thereon written indicia 210. The written indicia 210 may typically include textual information such as the name of the restaurant, sporting event, or promotion, or graphic information such as ornamental designs, company logos, and the like. The written indicia 210 is preferably printed on the rotatable label 200 using conventional silk-screening or lithographic methods. According to one manufacturing technique, indicia is printed on a rear surface of a rotatable label formed from a transparent material such that the indicia is viewable through the front surface of the label. Areas of the label which lie outside of the indicia (with the exception of a transparent window, discussed below) are then printed with a background scheme which renders these areas opaque so that underlying indicia on the exterior surface of the vessel is not viewable through the opaque areas of the label.

The rotatable label 200 includes a transparent window 212 defined by window edges 214*a–d*. The transparent window 212 may be formed of a substantially transparent shrinkwrap material, or may alternatively comprise an open area formed in the rotatable label 200. It is to be noted that while only one transparent window 212 is depicted in the figures, the present invention may have a plurality of transparent windows. As is discussed in further detail below, the transparent window 212 enables viewing of an underlying subset of indicia 228 disposed on an exterior surface 230 of the drinking vessel 216.

The drinking vessel 216 of FIG. 2A is similar to the drinking vessel 100 described in conjunction with FIG. 1. The vessel 216 includes a top end 218, a bottom end 220, and a tapered section 222 extending between the top and bottom ends 218 and 220. A drinking rim 224 is located near the top end 218 and defines an opening 226. Furthermore, written indicia 228 is disposed on the exterior surface 230 of the vessel 216 (either directly on the surface 230 or on a label affixed to the surface 230).

Figure 2B:
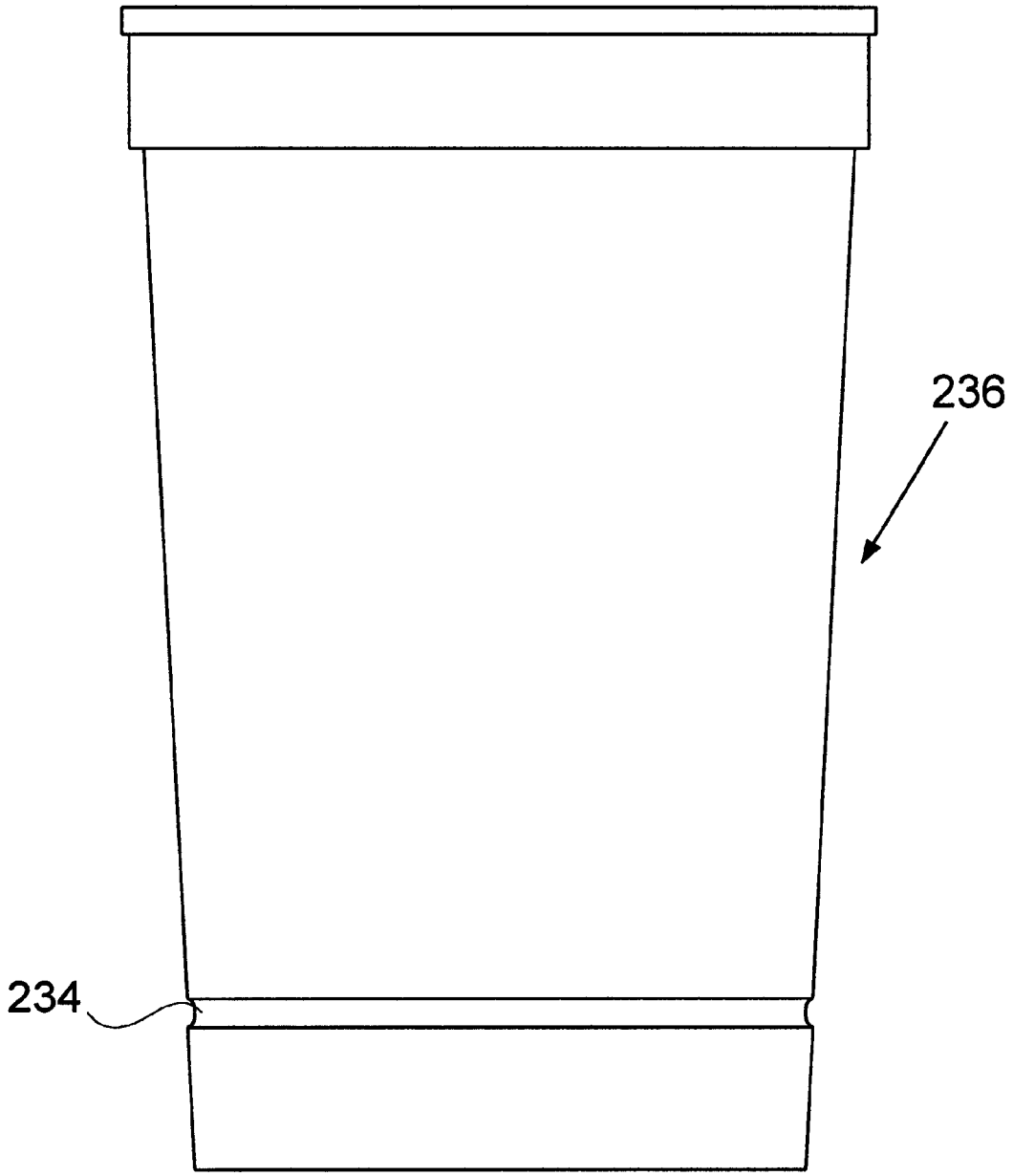
FIG. 2B is a front view of an alternative embodiment of a drinking vessel.

Unlike the prior art vessel 100 of FIG. 1, the drinking vessel 216 further includes a surface contour 232 located on the tapered section 222 near the bottom end 220. FIG. 2A shows the surface contour 232 as being a continuous raised rim extending circumferentially around the vessel 216. Alternatively, a surface contour 234 may comprise a depression extending around the circumference of a vessel 236 as shown in FIG. 2B. Furthermore, the surface contours may be disposed at various locations around the vessel to inhibit longitudinal displacement of the rotatable label and may comprise a plurality of surface contours.

FIGS. 3A to 3D show a preferred method for the automated manufacturing of the rotatable label system about the drinking vessel 216 of FIG. 2A. The positioning of the rotatable label 200 about the drinking vessel 216 is critical because the transparent window 212 of the label 200 must be placed such that underlying indicia 228 is properly framed by the transparent window 212 in the finished configuration of the label system. The present invention encompasses a method for achieving precise positioning of the rotatable label 200 in an automated manufacturing environment, where the drinking vessels are moved between the various manufacturing stations by a conveyor or similar transport means. This method, illustrated by FIGS. 3A to 3D, facilitates rapid and inexpensive manufacturing of the rotatable label/vessel assembly.

Figure 3A:
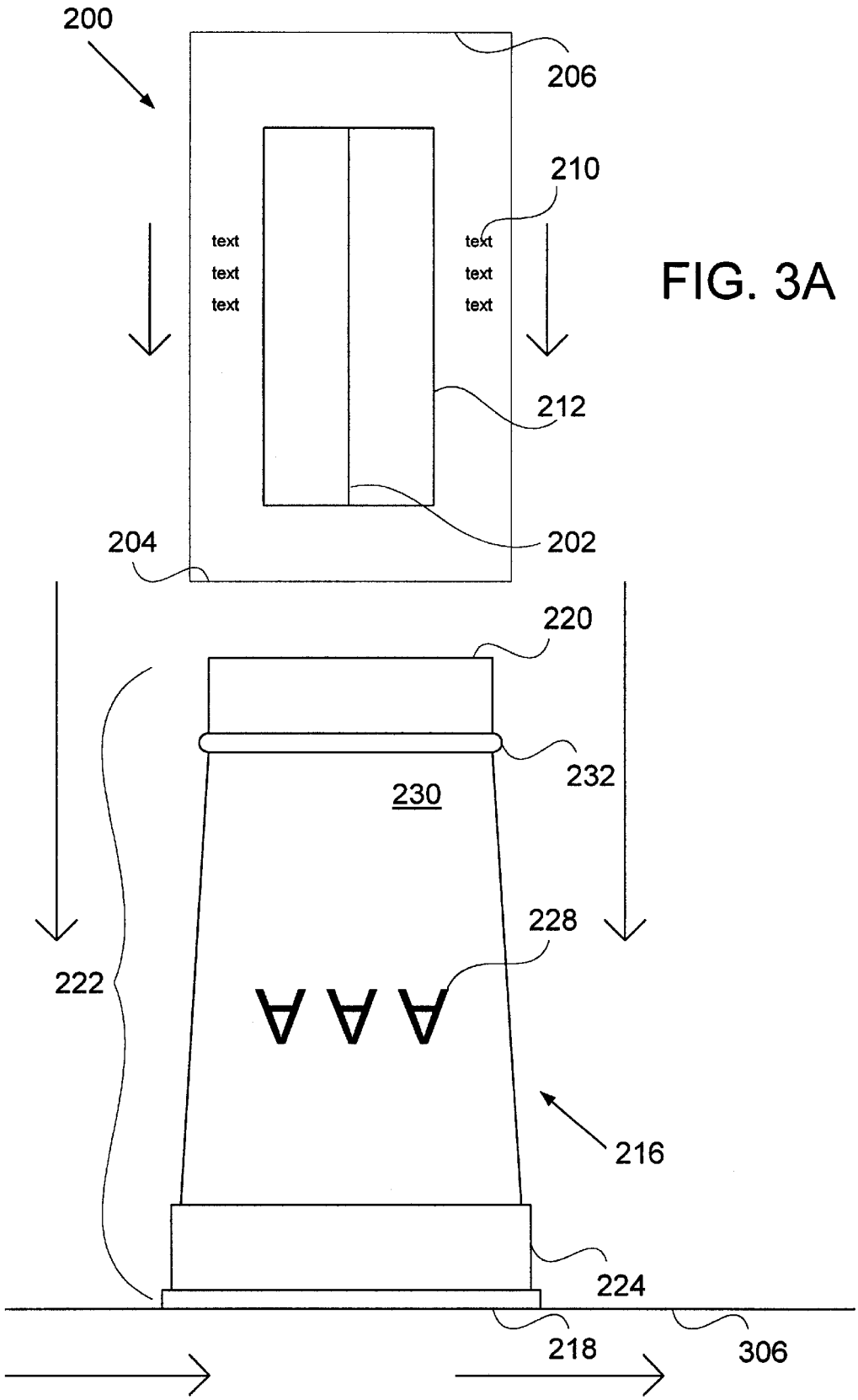
FIG. 3A is a front view of the rotatable label of FIG. 2 being lowered towards the drinking vessel of FIG. 2.

In FIG. 3A, the first step in the construction of the rotatable label system on the drinking vessel 216 is illustrated. Initially, the drinking vessel 216 is inverted so that the top end 218 of the vessel is now supported on a conveyor 306, which moves the vessel 216 as the rotatable label 200 is being disposed about the vessel 216. The rotatable label 200 shell is positioned above the inverted vessel 216, such that the rotatable label 200 is centered about a central longitudinal axis of the drinking vessel 216. Once the rotatable label 200 is properly aligned with the vessel 216, the rotatable label 200 is forced downward over the vessel 216 by an element of a labeling apparatus (not shown). Subsequently, the drinking vessel 216 is received within a portion of the chamber 208.

Figure 3B:
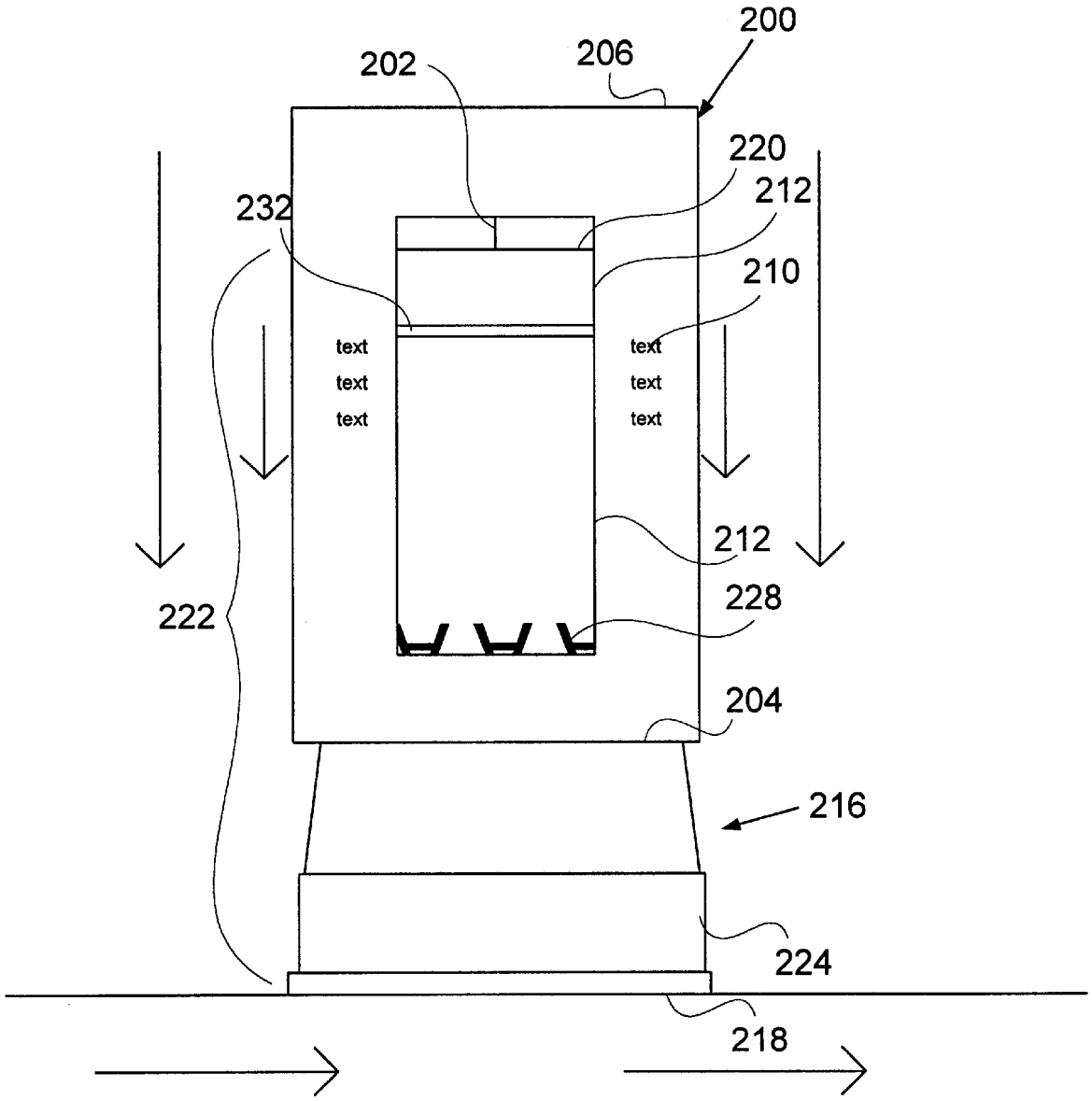
FIG. 3B is a front view of the rotatable label and drinking vessel of FIG. 3A wherein the rotatable label is partially advanced over the drinking vessel.

FIG. 3B shows a front view of the rotatable label 200 partially advanced longitudinally over the bottom end 220 and a lower portion of the tapered section 222 as the rotatable label 200 and the vessel 216 are advanced along the conveyor 306. As illustrated, the rotatable label 200 is lowered approximately halfway over the vessel 216 such that a first portion of the written indicia 228 is covered by the rotatable label 200 and a second portion of the written indicia 228 is visible through the transparent window 212.

Figure 3C:
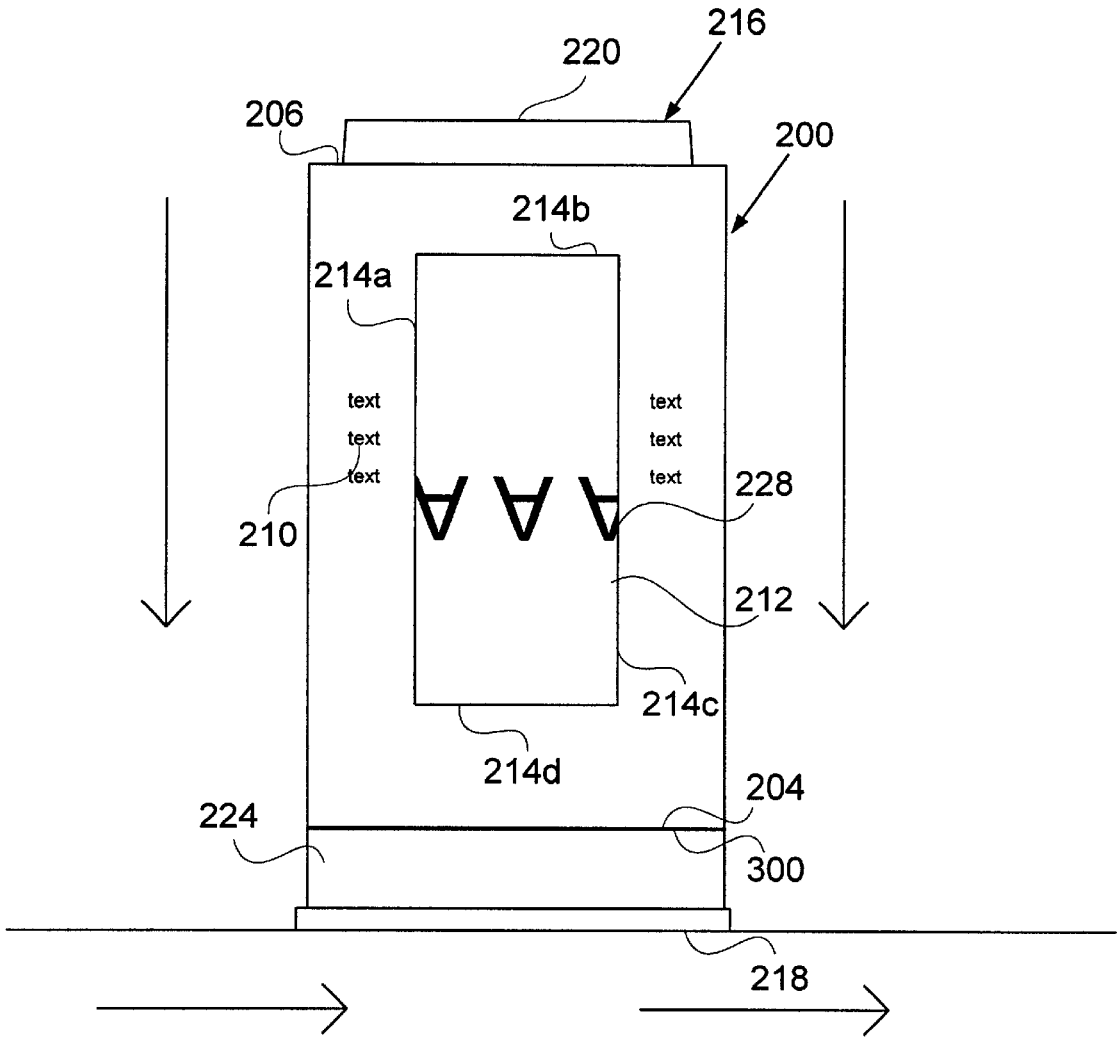
FIG. 3C is a front view of the rotatable label and drinking vessel of FIG. 3A wherein the rotatable label is positioned about the drinking vessel.

Because the circumference of the drinking vessel 216 steadily expands outwardly from the bottom end 220 towards the relatively wide top end 218, the label 200 will easily advance over the smaller bottom end 220 under the force of the element of the labeling apparatus. However, the rotatable label 200 will stop longitudinally advancing once the top edge 204 encounters a label stop location 300, where the circumference of the label stop location 300 equals that of the top edge 204 of the rotatable label 200. As shown in FIG. 3C, the label stop location 300 is on a lower margin 302 of the drinking rim 224. However, other embodiments may position the label stop location 300 on a different section of the drinking vessel 216 depending on the design of the drinking vessel 216 and the desired location of the rotatable label 200 relative to the vessel 216.

As discussed earlier, it is critical that the written indicia 228 be viewable through and properly framed by the transparent window 228. Therefore, the transparent window 228 must be properly sized and positioned such that the indicia 228 appears longitudinally between window edges 214*b* and 214*d* when the rotatable label 200 is advanced to its final position with respect to the vessel 216.

Figure 3D:
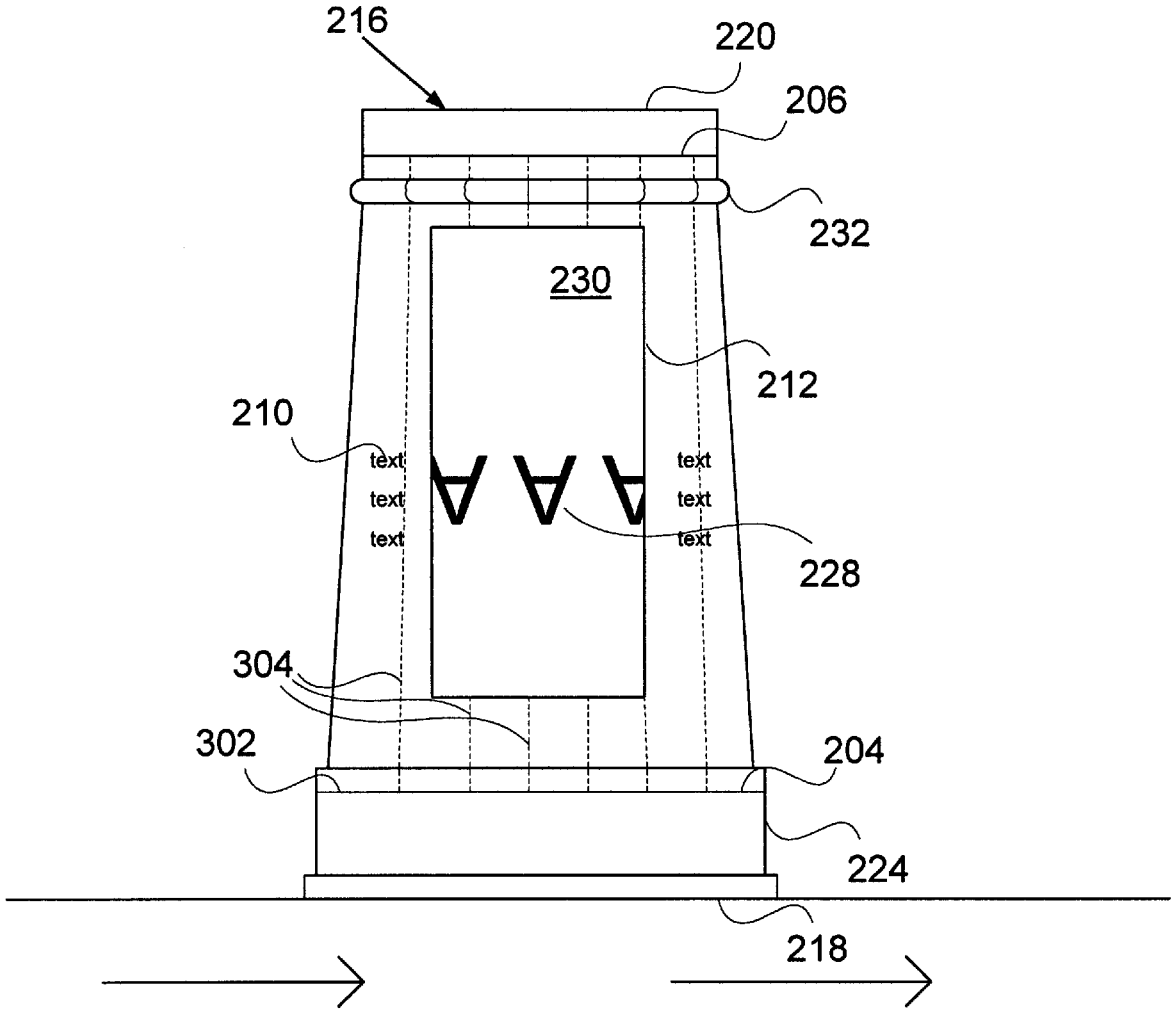
FIG. 3D is a front view of the rotatable label and drinking vessel of FIG. 3A with the rotatable label heat-shrunk about the drinking vessel.

FIG. 3D is a front view of the label system in its finished configuration following heat application to the shrinkwrap rotatable label 200. As shown, the rotatable label 200 generally conforms to the surface features of the vessel 216, with the top edge 204 of the rotatable label 200 overlapping a portion of the drinking rim 224. The bottom edge 206 covers a segment of the tapered section 222 immediately below the surface contour 232. Contour lines 304 illustrate the degree of shrinkage of the rotatable label 200 about the vessel 216. Although the rotatable label 200 is depicted as covering the surface contour 232 and a section of the drinking rim 224, the rotatable label 200 may optionally be positioned between and/or over various other contours, as will be discussed in more detail below.

Those skilled in the art will recognize that a number of factors may be adjusted to control the shrinkage of the rotatable label 200 during the heat shrinking process. These factors include the initial dimensions of the rotatable label 200, the material(s) from which the rotatable label 200 is fabricated, the duration of the heat shrinking process, and the conditions (temperature, etc.) at which heat shrinking is performed.

Figure 3E:
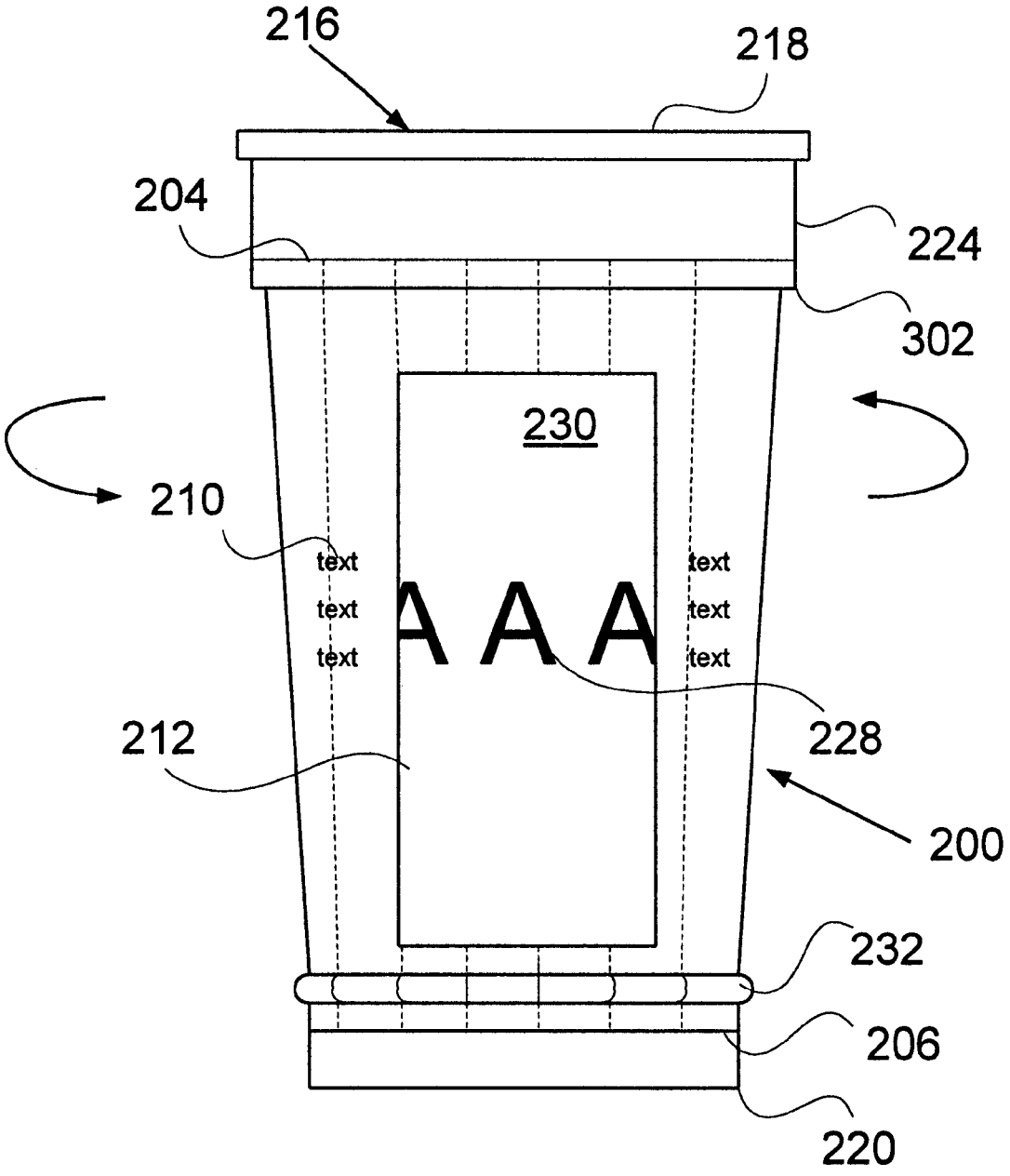
FIG. 3E is a front view of the rotatable label and drinking vessel of FIG. 3A with the rotatable label rotated with respect to the drinking vessel.

FIG. 3E shows the vessel 216 in the upright position with the rotatable label 200 rotatably disposed about the vessel 216. The rotatable label 200 is longitudinally maintained on the vessel 216 by the downward taper of the vessel 216 and the surface contour 232. In this configuration, the taper of the vessel 216 prevents the rotatable label 200 from moving upward because the diameter of the bottom edge 206 of the rotatable label 200 is smaller than the diameter of the vessel 216 immediately above the bottom edge 206. Similarly, the lower margin 302 of the drinking vessel 216 prevents the rotatable label 200 from moving upward because the diameter of the rotatable label 200 immediately below the lower margin 302 is smaller than the diameter of the vessel 216 at or about the lower margin 302.

Furthermore, surface contour 232 is provided to prevent displacement of the rotatable label 200 relative to the vessel 216. The portion of the rotatable label 200 that covers the surface contour 232 shrinks to a circumference that is larger than portions of the label 200 in adjacent regions of the vessel 216. Because the rotatable label 200 portions immediately adjacent to the surface contour 232 shrink to a circumference that is smaller than the surface contour 232, these rotatable label 200 portions can not move over the surface contour 232. Thus, the surface contour 232 longitudinally maintains the rotatable label 200 about the drinking vessel 216.

The rotatable label 200 of FIG. 3E is shown rotated relative to its initial position depicted in FIG. 3D. The transparent window 212 permits a user to view an underlying subset of indicia 228 disposed on an inner label or exterior surface 230 of the vessel 216. The user selects the subset of indicia 228 to be viewed by rotating the rotatable label 200 such that the selected subset of the indicia 228 appears within the transparent window 212. A slip agent may be applied between the rotatable label 200 and the adjacent surfaces of the vessel 216 to ensure that the rotatable label 200 is free to rotate about the drinking vessel 216.

Figure 4A:
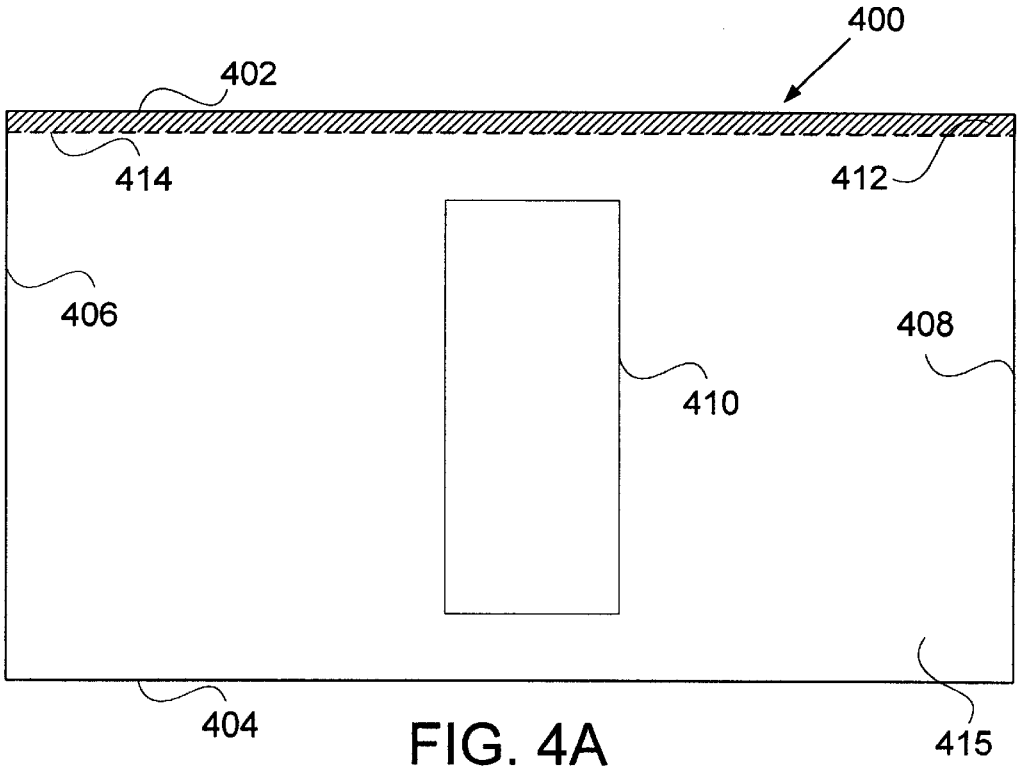
FIG. 4A is a front view of one embodiment of a heat-shrinkable sheet.

FIGS. 4A to 4D show another implementation of the present invention. In FIG. 4A a front view of a rear surface of a heat-shrinkable sheet 400 having a top edge 402, a bottom edge 404, a left edge 406, and a right edge 408 is shown. Written indicia is preferably imprinted on the heat-shrinkable sheet 400 before the sheet 400 is formed into a shell. A section of the sheet 400 is left void of written indicia, and thus forms a transparent window 410.

FIG. 4A also shows a top border 412 located between the top edge 402 and a perforation line 414. An adhesive pattern may be disposed on the rear surface of the top border 412, thus inhibiting the activation of the rotation system until the label 415 is intentionally uncoupled from the top border 412. Uncoupling of the top border 412 from the label 415 is effected by manually exerting a torque on label 415, which in turn applies a shear force to perforation line 414, causing it to tear. After the label 415 is uncoupled from the top border 412, the top border 412 will remain fixedly attached to the vessel 418, while the rotatable label 415 may freely rotate about the vessel 418.

Figure 4B:
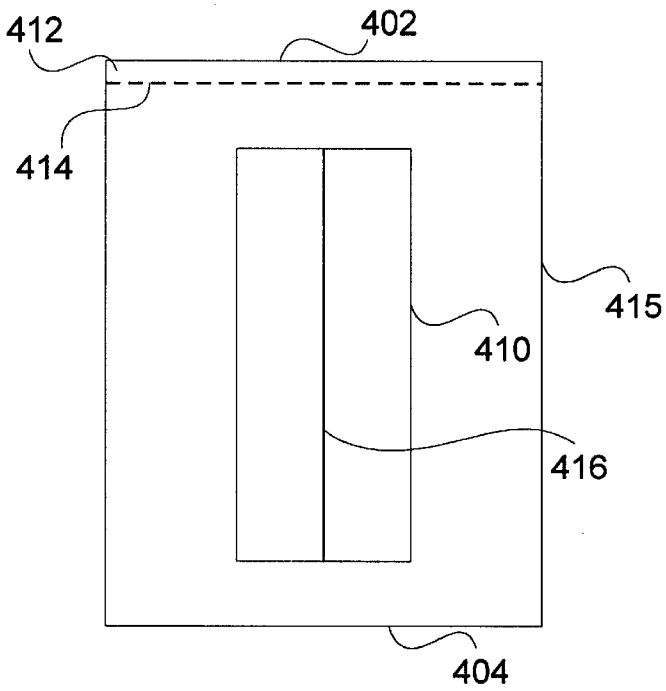
FIG. 4B is a front view of the heat-shrinkable sheet of FIG. 4A formed into a shell.

FIG. 4B shows the sheet 400 formed into a tubular-shaped shell 417, by overlapping the left and right edges 406 and 408 (FIG. 4A). The overlapped portion is welded together along the label seam 416 as seen through the transparent window 410 of FIG. 4B. The sheet 400 now forms a shell, which may be disposed about a drinking vessel 418 (FIG. 4C) in accordance with the method previously discussed in conjunction with FIGS. 3A to 3D.

Figure 4D:
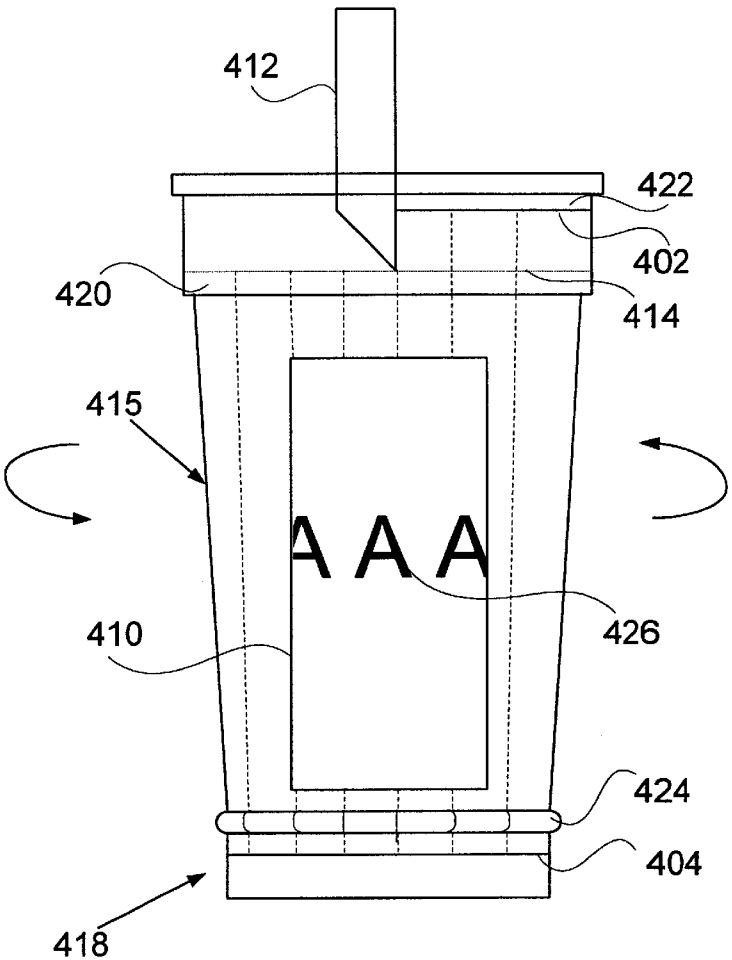
FIG. 4D is a front view of the rotatable label portion of the shell of FIG. 4B wherein a perforation portion of the shell is being removed.
Figure 4C:
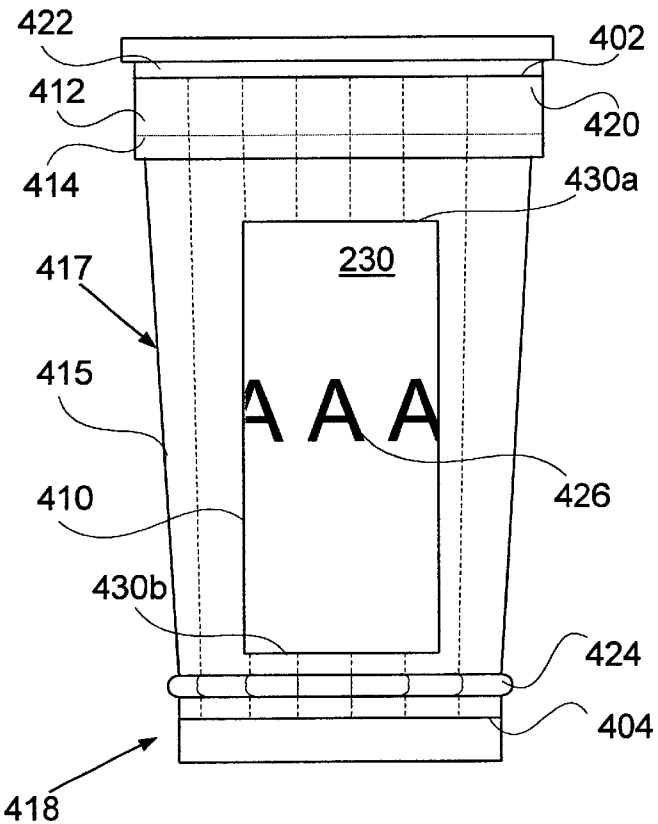
FIG. 4C is a front view of the shell of FIG. 4B heat-shrunk about a drinking vessel.

FIG. 4C is a front view of the shell 417 of FIG. 4B heat-shrunk about a drinking vessel 418. As shown, the top border 412 and the perforation line 414 cover a lower margin 420 of a drinking rim 422, while the bottom edge 404 is located below a surface contour 424 of the vessel 418. The shell 417 is positioned such that written indicia 426 on the vessel 418 is situated between a top and bottom window edge 430*a* and 430*b* of the transparent window 410.

FIG. 4D is a front view of the shell 417 of FIG. 4B wherein the rotatable label 415 is rotated relative to the vessel 418. As discussed above, the application of a torque to the rotatable label 415 will uncouple the label 415 from the top border 412 along the perforation line 414. Subsequent to the uncoupling of the rotatable label 415 from the top border 412, the top border 412 remains removably affixed to the vessel 418, and may be removed from around the vessel 418, as shown in FIG. 4D. Alternatively, the top border 412 may be left affixed to the vessel 418 to thereby inhibit the upward longitudinal movement of the rotatable label 415. The rotatable label 415 is now free to rotate relative to the drinking vessel 418.

Figure 5:
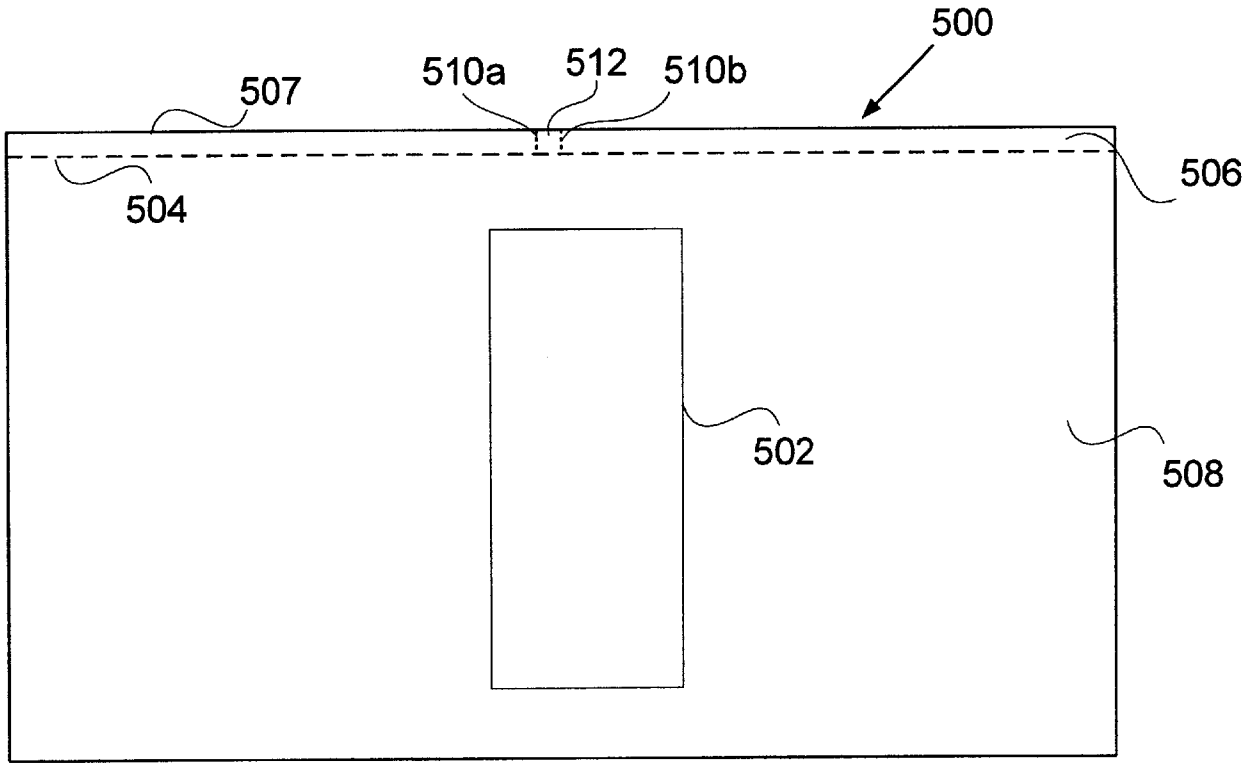
FIG. 5 is a front view of another embodiment of a heat-shrinkable sheet.

FIG. 5 illustrates an alternative embodiment of a heat-shrinkable sheet 500 with a transparent window 502 disposed therein. Sheet 500 includes a horizontal perforation line 504 dividing a top border 506 from a rotatable label 508. The top border 506, which extends between a top edge 507 and the perforation line 504, has an adhesive disposed thereon to prevent rotation of the rotatable label 508 prior to the intentional uncoupling of the top border 506 from the label 508. Sheet 500 further incorporates two vertical perforation lines 510*a–b*, which form a release tab 512. This release tab 512 facilitates the removal of the top border 506 after the top border 506 is detached from the rotatable label 508 along the horizontal perforation line 504.

Figure 6A:
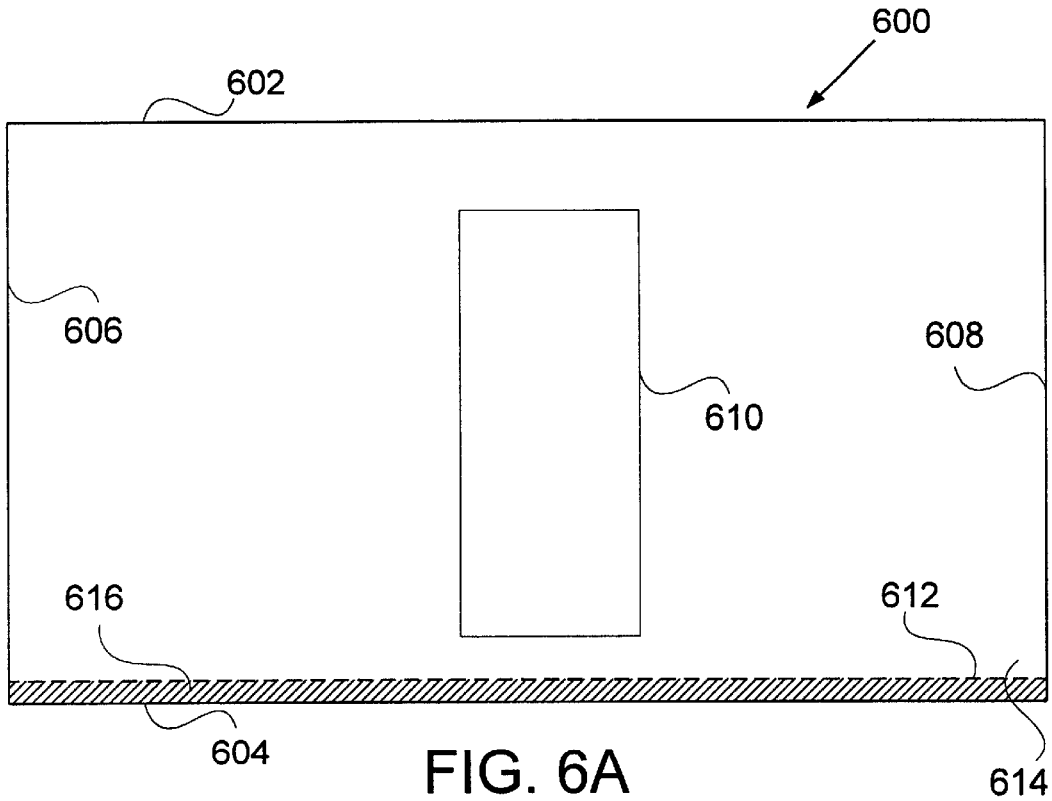
FIG 6A is a front view of another embodiment of a heat-shrinkable sheet.

FIG. 6A shows another embodiment of a heat-shrinkable sheet 600 having a top edge 602, a bottom edge 604, a left edge 606, a right edge 608, and a transparent window 610 disposed in the sheet 600. In this embodiment, a horizontal perforation line 612 is located near the bottom edge 604 of the sheet 600, thus defining a bottom border 616 extending between the bottom edge 604 and the perforation line 612. The perforation line 612 consequently divides the bottom border 616 from a rotatable label 614 portion of the sheet 600. The bottom border 616 preferably has an adhesive disposed thereon to prevent rotation of the rotatable label 614 prior to the intentional uncoupling of the bottom border 616 from the rotatable label 614.

Figure 6B:
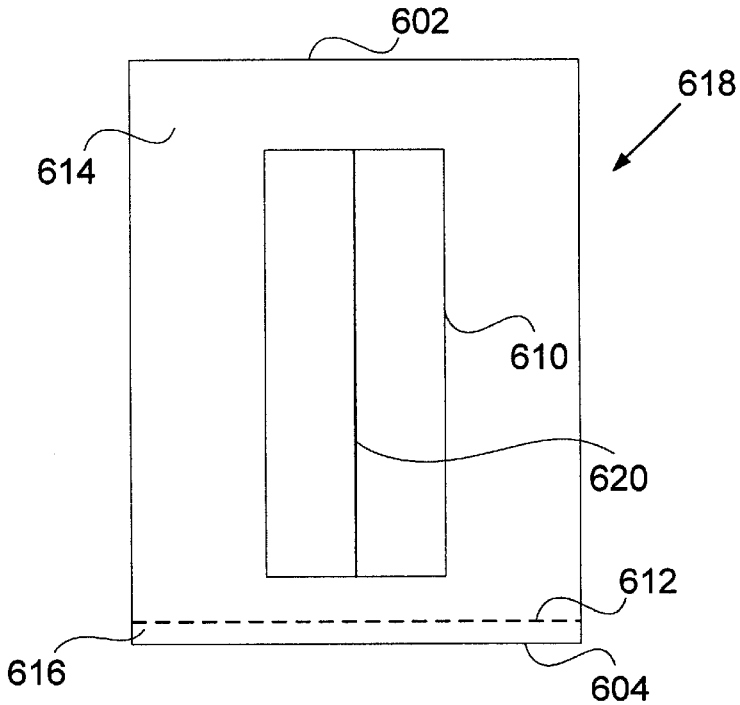
FIG. 6B is a front view of the heat-shrinkable sheet of FIG. 6A formed into a shell.

FIG. 6B shows the sheet 600 of FIG. 6A formed into a tubular shell 618, by the overlap of the left and right edges 606 and 608 thus forming a seam 620. The tubular shell 618 may now be rotatably disposed about the prior art drinking vessel 100 of FIG. 1, as shown in FIG. 6C. The method applied to manufacture this rotatable label system is the same as described in conjunction with FIGS. 3A–3D. Initially, the drinking vessel 100 is inverted and the tubular shell 618 is longitudinally advanced over the drinking vessel 100. In this embodiment, the shell stop location 622 is located below the drinking rim 106. Once the shell 618 is properly positioned, heat is applied to the heat-shrinkable shell 618, resulting in the shell 618 conforming to the surface features of the vessel 100.

Figure 6D:
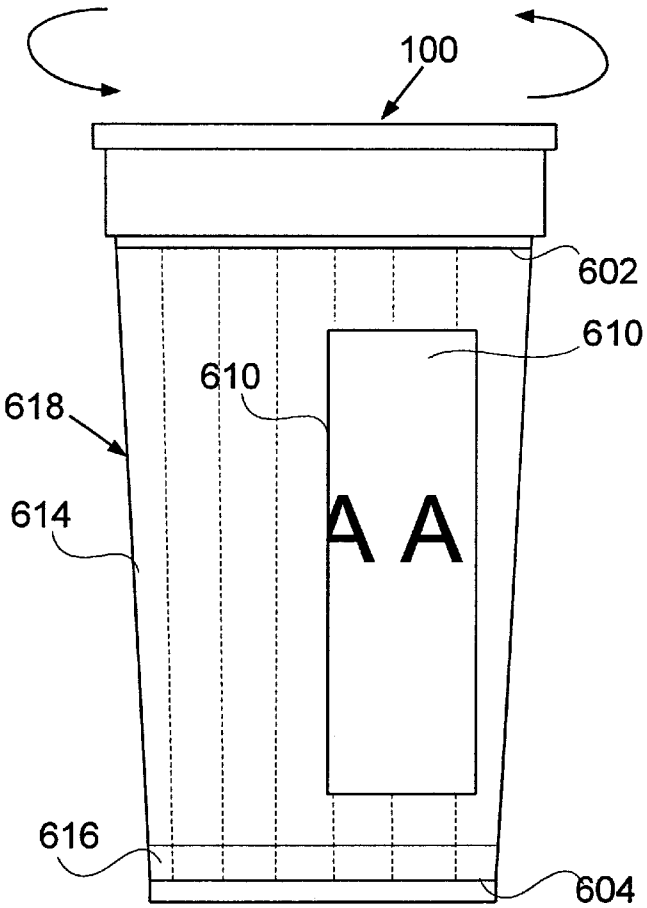
FIG. 6D is a front view of a rotatable label of the shell of FIG. 6B wherein the rotatable label is being rotated relative to the drinking vessel.
Figure 6C:
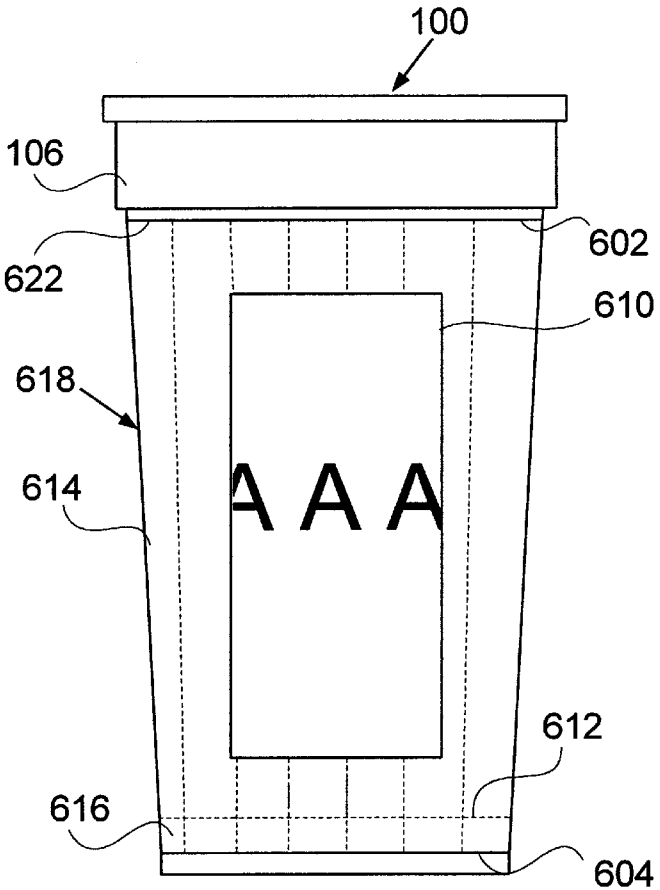
FIG. 6C is a front view of the shell of FIG. 6B heat-shrunk about a drinking vessel.

FIG. 6D shows the rotating label system after the initial rotation of the rotatable label portion 614 relative to the vessel 100, which causes the rotatable label 614 to be detached from the bottom border 616 along the horizontal perforation line 612. The bottom border 616 remains affixed to the vessel 100 to prevent the downward displacement of the rotatable label. Furthermore, the taper of the vessel 100 inhibits the upward displacement of the rotatable label 614 because the diameter of the bottom edge 604 of the rotatable label 614 is smaller than the diameter of the vessel 100 immediately above the bottom edge 604.

Figure 7:
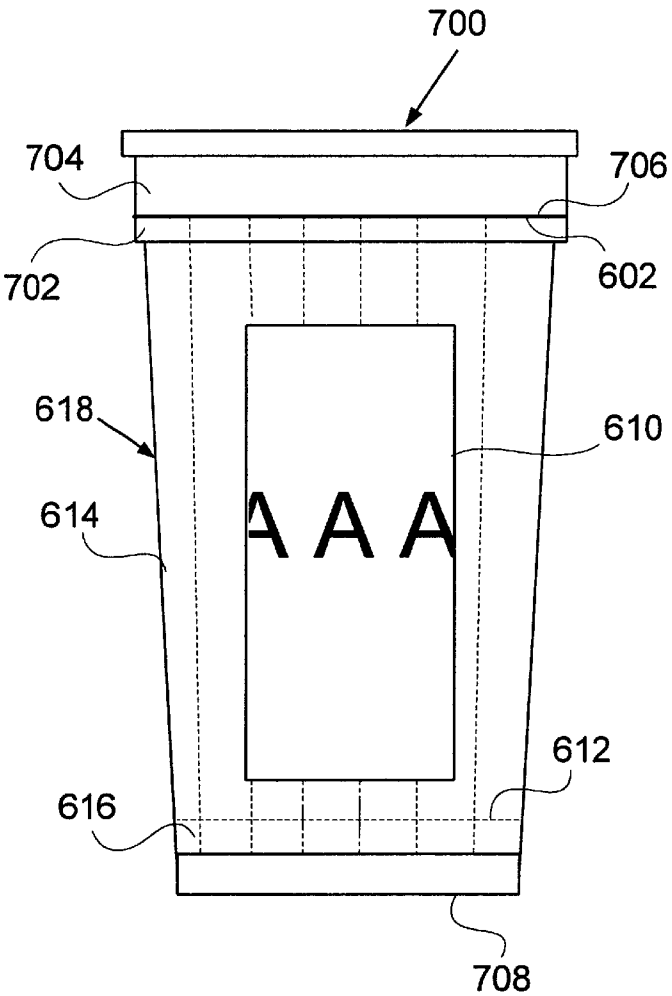
FIG. 7 is a front view of another embodiment of a drinking vessel with a rotatable label disposed thereon.

FIG. 7 shows yet another embodiment of the present invention. In this embodiment, the shell 618 of FIG. 6B is heat-shrunk about a drinking vessel 700, such that the top edge 602 of the shell 618 overlaps a lower margin 702 of a drinking rim 704. Thus, during the manufacturing process, the circumference of the shell 618 is sized such that the shell stop location 706 is on the drinking rim 704.

The initial rotation of the rotatable label 618 uncouples the rotatable label 618 from the bottom border 616, which remains fixedly attached to the vessel 700. The bottom border 616 now functions as a label boundary to inhibit the downward displacement of the rotatable label 618. Upward displacement of the rotatable label 618 is prevented by the drinking rim 704 because the diameter of the rotatable label 618 shrinks to a diameter smaller than the diameter of the drinking rim 704. Thus, the rotatable label 618 is inhibited from moving past the drinking rim 704. Additionally, the taper of the vessel 700 prevents the upward displacement of the rotatable label 618 because the diameter of a bottom edge 708 is smaller than the diameter of the vessel 700 above the bottom edge 708.

The adhesion of the border of the rotatable label to the drinking vessel as described in FIGS. 4*a*–7 is a vital feature for game promotions. For example, the written indicia found on the outer surface of the drinking vessel may include an announcement that the person in possession of the vessel has won a prize. This announcement is initially covered from view by the rotatable label disposed about the vessel. The announcement may only be viewed by rotating the label until the announce appears within the transparent window. However, the game promoter does not want individuals to have the ability to view the announcements prior to the drinking vessel being purchased or given to an intended end user of the product. Thus, the adhered border inhibits the activation of the rotation system until the label is intentionally uncoupled from the border by the end user.

Figure 8:
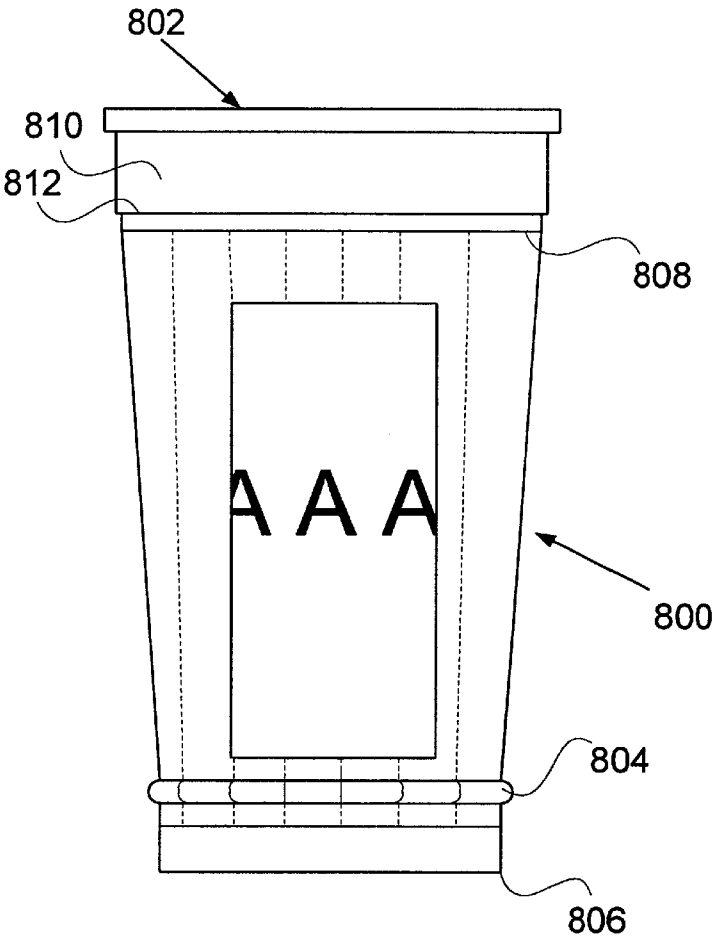
FIG. 8 is a front view of another embodiment of a drinking vessel with a rotatable label disposed thereon.

FIG. 8 shows yet another embodiment of a rotatable label system. This embodiment presents a rotatable label 800 disposed about a drinking vessel 802 having a surface contour 804 located near a bottom end 806 of the vessel 802. A shell stop location 808 is located just below a drinking rim 810 with a lower edge 812 of the drinking rim 810 functioning as a top label boundary. The taper of the vessel 802 further inhibits the upward displacement of the rotatable label 800, while the surface contour 804 prevents the downward movement of the rotatable label 800. Because the diameter of the rotatable label 800 in the regions immediately adjacent to the surface contour 804 shrinks to a diameter smaller than the surface contour 804, the rotatable label 800 is longitudinally maintained about the vessel 802.

Figure 9:
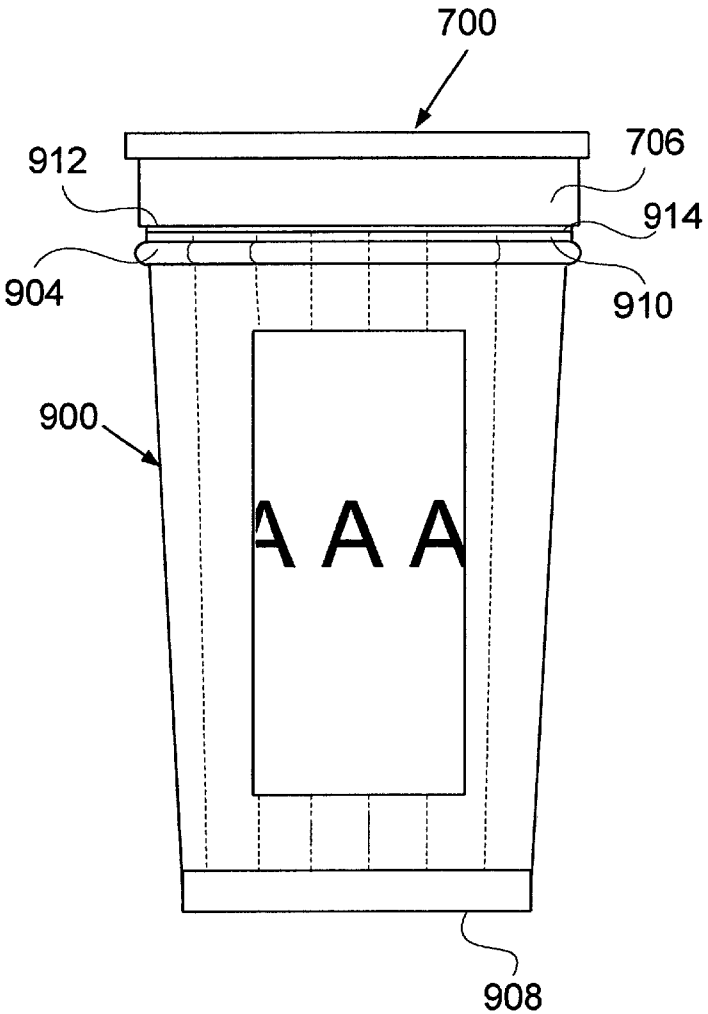
FIG. 9 is a front view of yet another embodiment of a drinking vessel with a rotatable label disposed thereon.

FIG. 9 shows a further embodiment of a rotatable label system having a rotatable label 900 disposed about a drinking vessel 902. The drinking vessel 902 of FIG. 9 includes a surface contour 904 located near a drinking rim 906 of the vessel 902. The rotatable label 900 is positioned below the drinking rim 906, over the surface contour 904, and ends short of a bottom end 908 of the vessel 902. Since a label stop location 910 is situated between the drinking rim 906 and the surface contour 904, a top edge 914 of the rotatable label 900 is hindered from moving upwardly by the larger diameter drinking rim 906. Furthermore, the surface contour 904 prevents the downward displacement of the rotatable label 800 because the diameter of the rotatable label 800 in the regions adjacent to the surface contour 904 are smaller than the diameter of the surface contour 904, and thus cannot move over the surface contour 904.

Figure 10:
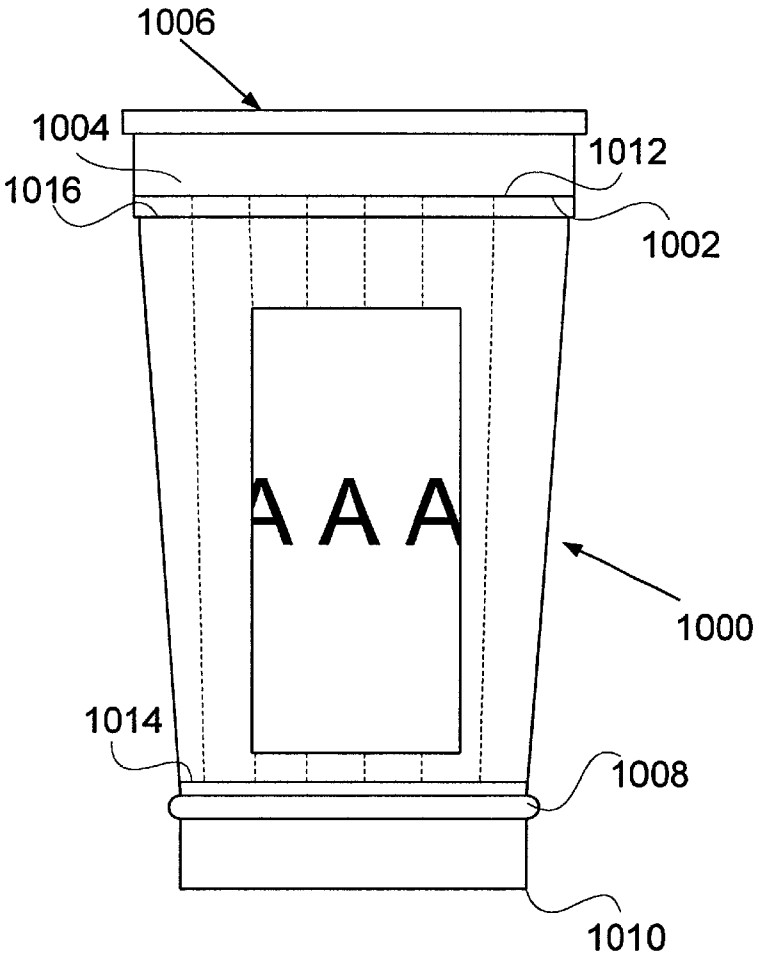
FIG. 10 is a front view of yet another embodiment of a drinking vessel with a rotatable label disposed thereon.

FIG. 10 is a front view of another embodiment of a rotatable label 1000 disposed about a drinking vessel 1006. This embodiment shows the rotatable label 1000 as having a label stop location 1002 on a portion of a drinking rim 1004 of the vessel 1006. The vessel 1006 also includes a surface contour 1008 located near a bottom end 1010 of the vessel 1006.

During manufacture of this label system, the rotatable label 1000 is designed such that a top edge 1012 rests at the label stop location 1002, while a bottom edge 1014 is positioned above the surface contour 1008. After the application of heat, the rotatable label 1000 generally conforms to the taper of the vessel 1006 and the surface features of the drinking rim 1004. A lower edge 1016 of the drinking rim 1004 now prevents the upward movement of the rotatable label 1000 because the diameter of rotatable label 1000 immediately below the lower edge 1016 is smaller than the lower edge, and thus cannot move up. Further, the surface contour 1008 acts as a lower label boundary impeding the downward movement of the rotatable label 1000.

Figure 11:
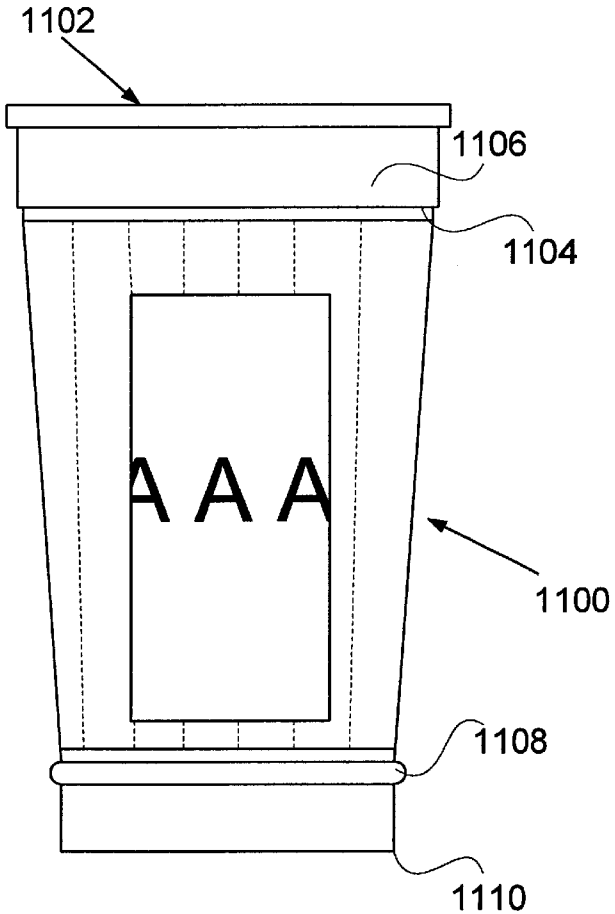
FIG. 11 is a front view of yet another embodiment of a drinking vessel with a rotatable label disposed thereon.

FIG. 11 illustrates yet another embodiment of a rotatable label 1100 rotatably disposed about a drinking vessel 1102. In this embodiment, the rotatable label 1100 is positioned between a lower edge 1104 of a drinking rim 1106 and a surface contour 1108 located near a bottom end 1110 of the vessel 1102. Heat application generally conforms the heat-shrinkable rotatable label 1100 to the shape and contours of the vessel 1102, whereby the lower edge 1104 and the surface contour 1108 act as label boundaries to prevent the vertical displacement of the rotatable label 1100.

Figure 12:
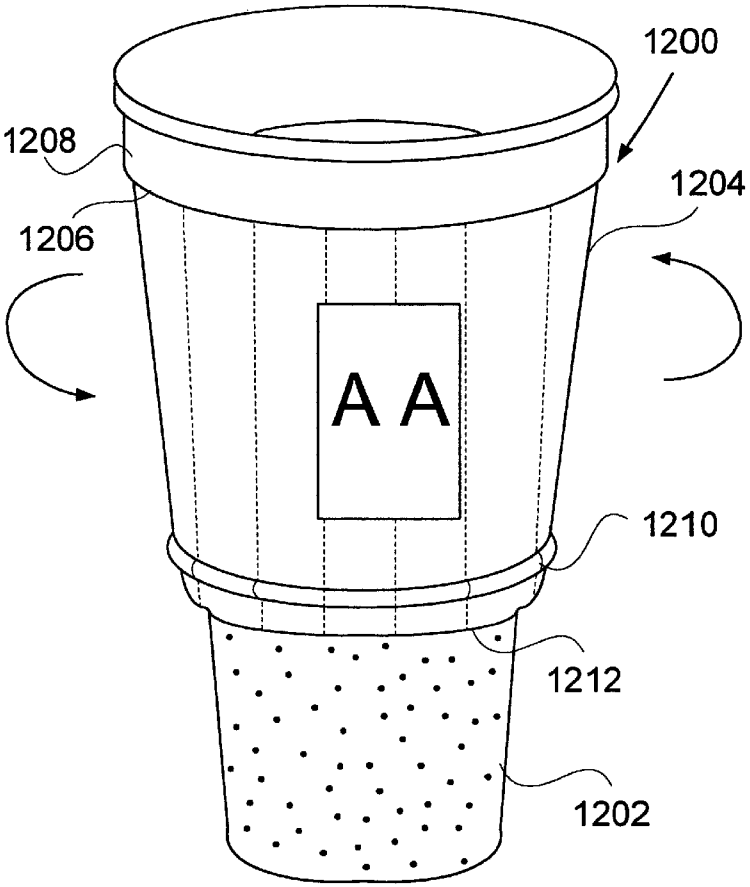
FIG. 12 is a perspective view of a drinking vessel having a gripping portion.

FIG. 12 is a perspective view of a drinking vessel 1200 having a gripping portion 1202 formed in a lower section of the drinking vessel 1200. The gripping portion 1202 preferably does not have a rotatable label 1204 disposed thereon and may include a textured surface to provide a user with a more secure grip. In this embodiment, the rotatable label 1204 is positioned between the gripping portion 1202 and a lower edge 1206 of a drinking rim 1208.

The drinking vessel 1200 of FIG. 12 includes a surface contour 1210 for longitudinally maintaining the rotatable label 1204 about the vessel 1200. Although the surface contour 1210 is shown as being covered by the rotatable label 1204, the surface contour 1210 may alternatively be positioned below a bottom edge 1212 of the rotatable label 1204, thus acting as a lower label boundary, or in any other location about the vessel 1200. The rotatable label 1204 may alternatively overlap the lower edge 1206 of the drinking rim 1208.

Figure 13:
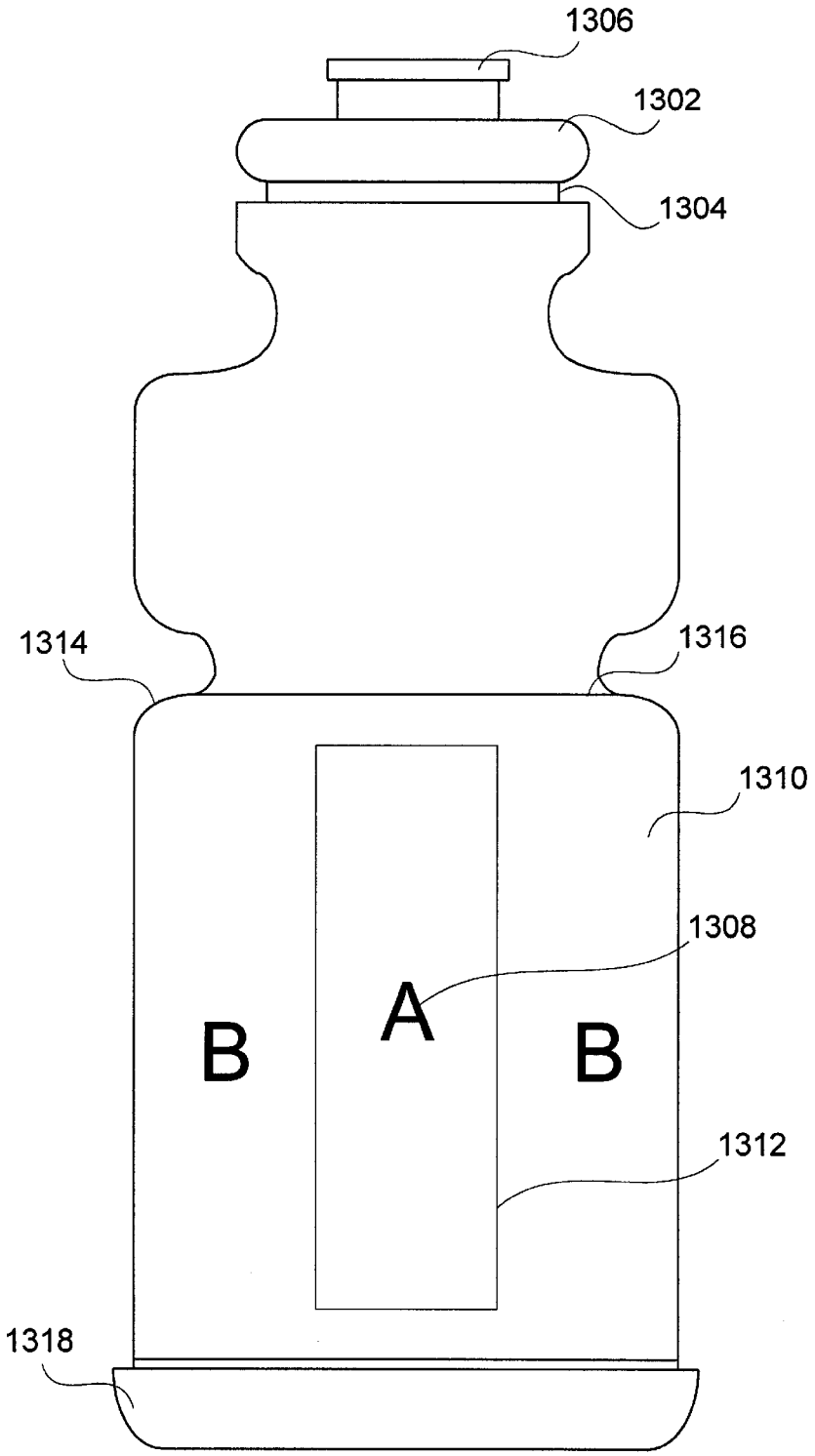
FIG. 13 is a front view of a drinking vessel having a closure on a top end.

FIG. 13 illustrates an alternative embodiment of a drinking vessel 1300 having a closure 1302 on a top end 1304 of the vessel 1300 (commonly referred to as a "sports bottle"). The closure includes a spout 1306 which opens to allow for the flow of liquid when in the up position and closes to stop fluid flow when in the down position. Those skilled in the art will recognize other embodiments of a drinking vessel, such as a water bottle or a cup with a handle, with which a rotatable label system may be applied to.

The drinking vessel 1300 further includes written indicia 1308 on the exterior surface of the vessel 1300 (either directly on the surface or printed on a label affixed to the exterior surface of the vessel 1300). A rotatable label 1310 is rotatably disposed over the written indicia 1308 such that a subset of the indicia 1308 is visible through a transparent window 1312 when the rotatable label 1310 is rotated relative to the vessel 1300.

Various surface features longitudinally maintain the rotatable label 1310 about the vessel 1300. A circumferential shoulder 1314 located near a top edge 1316 of the rotatable label 1310 inhibits the label 1310 from moving down because the circumference of the top edge 1316 is smaller than the shoulder 1314 at its widest expanse. A label panel 1318 found on the bottom of the vessel 1300 further prohibits the downward movement of the label 1310. Those skilled in the art will recognize other surface contours which may be utilized to prevent the label 1310 from longitudinally displacing.

Figure 14A:
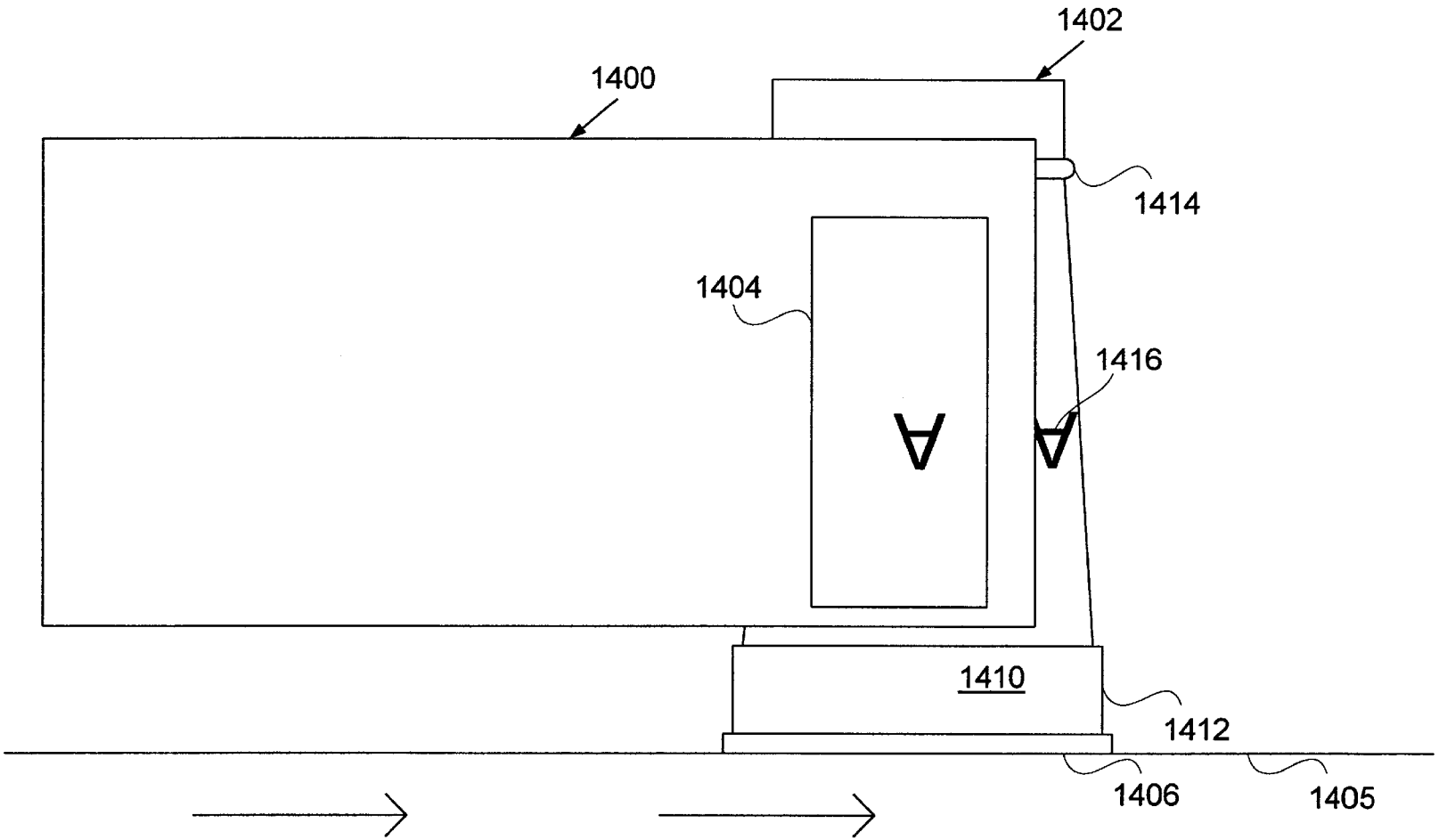
FIG. 14A is a front view of a heat-shrinkable sheet being rolled about a drinking vessel.

FIG. 14A shows an alternative method for disposing a heat-shrinkable sheet 1400 having a transparent window 1404 about a drinking vessel 1402. Initially, the drinking vessel 1402 is inverted so that a top end 1406 of the vessel 1402 is now located on a conveyor 1405. Alternatively, the sheet 1400 may be applied to the drinking vessel 1402 while the vessel 1402 is in an upright position.

A leading edge 1408 of the sheet 1400 is held stationary against an outer surface 1410 of the drinking vessel 1402. There are several techniques which may be utilized to temporarily affix the leading edge 1408 to the vessel 1402. A first method involves disposing a low-adhesion glue on the leading edge 1408 and/or on the adjacent surface 1410 of the vessel 1402. The bond thus formed is of sufficient strength to hold the leading edge 1408 stationary during the manufacturing process, but may be easily broken by a user with an application of a rotational force to the sheet 1400 after it is formed into a rotatable label. Another method involves wetting the leading edge 1408 and/or vessel 1402 to form a temporary bond, which is released when the wetting agent evaporates. Yet another method of securing the leading edge 1408 to the vessel 1402 is to generate a partial vacuum in a volume between the leading edge 1408 and the vessel 1402. Those skilled in the art will recognize that many other techniques may be employed to maintain the leading edge 1408 stationary relative to the drinking vessel 1402.

FIG. 14A also shows the drinking vessel 1402 having a drinking rim 1412, a surface contour 1414, and written indicia 1416 disposed on the exterior surface 1410 of the vessel 1402.

While the leading edge 1408 of the sheet 1400 is held stationary relative to the drinking vessel 1402, the remainder of the sheet 1400 is wrapped around the circumference of the vessel 1402. Wrapping of the sheet 1400 around the vessel 1402 may be advantageously accomplished by rotating the vessel while linearly feeding the sheet 1400 as the vessel is moved linearly along the conveyor 1405.

When the vessel 1402 has been rotated about its full circumference, the leading edge 1408 meets or is placed in overlapping relation with a trailing edge 1418, as shown in FIG. 4B. The trailing edge 1418 is preferably coated with an adhesive for securing the trailing edge 1418 to the overlapped region of the sheet 1400. Heat may then be applied to the sheet 1400 to cause it to shrink and conform to the drinking vessel 1402.

Figure 14C:
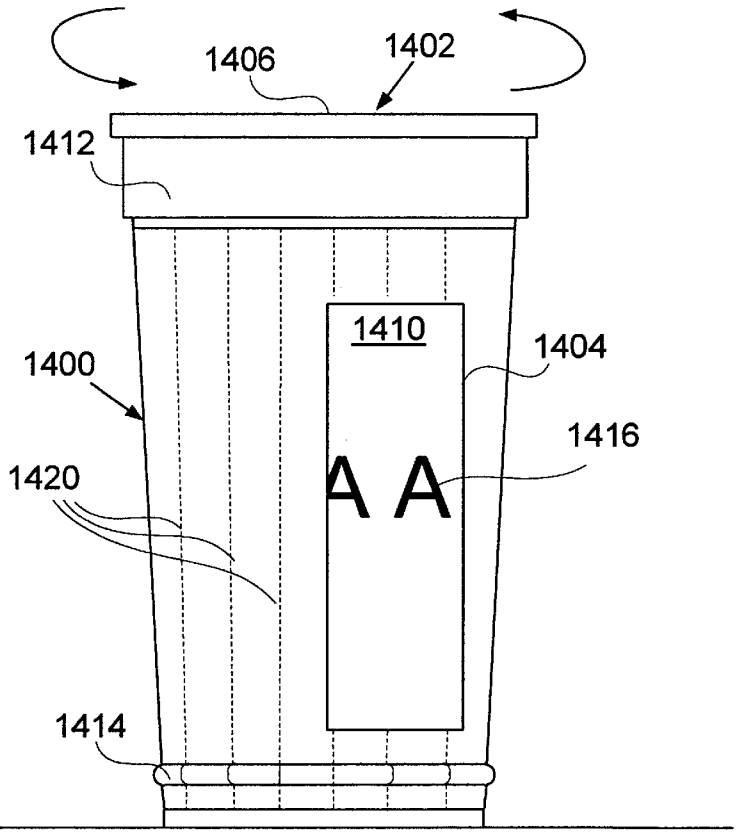
FIG. 14C is a front view of the sheet and drinking vessel of FIG. 14A after heat treatment.

FIG. 14C illustrates the end product of the foregoing label system construction technique. The sheet or shell 1400 conforms to the taper and the surface contour 1414 of the vessel 1402 as shown by contour lines 1420. The shell 1400 is consequently prohibited from longitudinal displacement relative to the vessel 1402 by the surface contour 1414 and the drinking rim 1412. By rotating the shell 1400 relative to the drinking vessel 1402, the user may view selected subsets of underlying written indicia 1416 disposed on the exterior surface 1410 of the vessel 1402. A slip agent may be disposed between the exterior surface 1410 and the shell 1400 to facilitate rotation of the shell 1400 relative to the drinking vessel 1402.

Figure 14B:
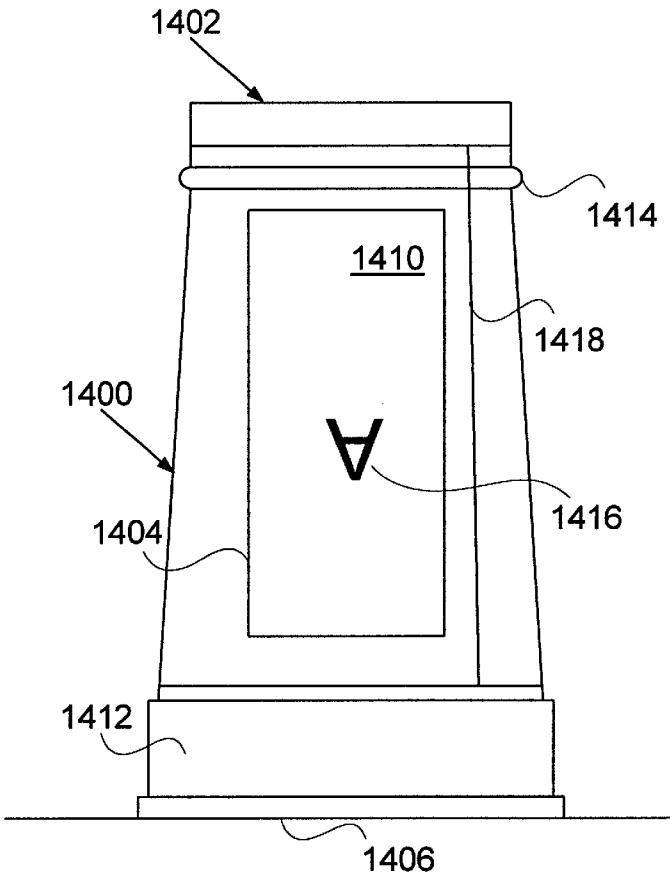
FIG. 14B is a front view of the sheet of FIG. 14A rolled about the drinking vessel before heat treatment.

Although FIGS. 14A–C describe a label system construction method utilizing a particular sheet 1400 and drinking vessel 1402, this method may alternatively be used to construct the various embodiments of the rotatable labels and drinking vessels discussed above. Furthermore, this method of label system construction preferably is conducted on a conveyor 1405 to increase the efficiency and speed of the method.

Figure 15A:
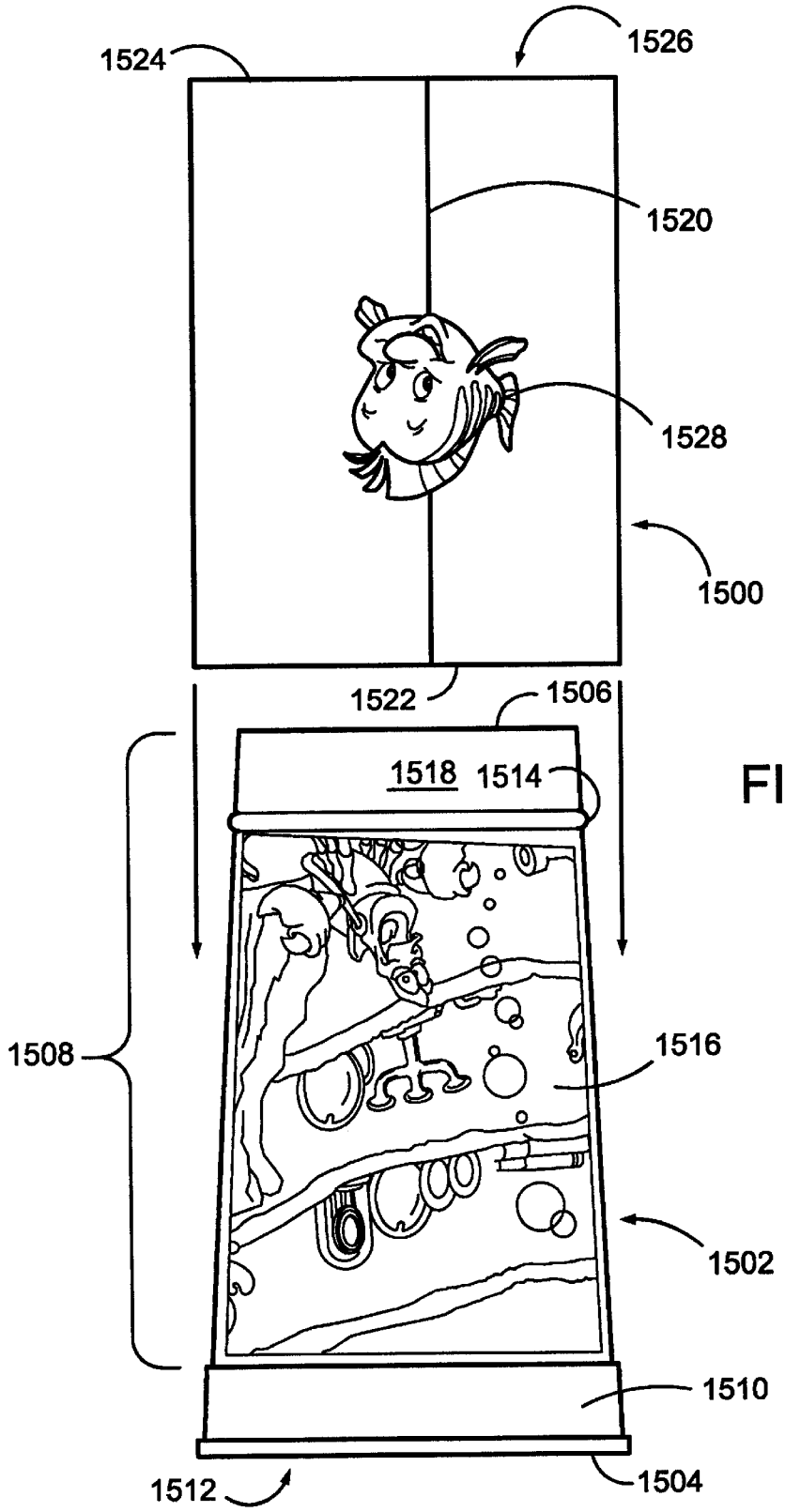
FIG. 15A is a front view of an alternative embodiment of a rotatable label and drinking vessel, according to the present invention.

FIG. 15A illustrates an alternative embodiment of a rotatable label 1500 and a drinking vessel 1502. The drinking vessel 1502 preferably comprises a top end 1504, a bottom end 1506, and a tapered region 1508 expanding outwardly from the bottom end 1506 towards the top end 1506. A drinking rim 1510 is formed at the top end 1504 and defines an opening 1512 for liquid flow into and out of the vessel 1502. A surface contour 1514 is located towards the bottom end 1506 on the tapered region 1508, which will be utilized to longitudinally maintain the rotatable label 1500 about the vessel 1502, as will be discussed in conjunction with FIG. 15B.

As shown in FIG. 15A, indicia 1516 is disposed on an exterior surface 1518 of the drinking vessel 1502 (either directly on the exterior surface 1518 or on a label affixed to the exterior surface 1518), and may consist of words, designs, or illustrations. The indicia 1516 of FIG. 15A depicts an underwater scene disposed on the exterior surface 1518 of the vessel 1502.

The rotatable label 1500 of FIG. 15A is preferably fabricated from a generally rectangular sheet of shrinkwrap material with opposing edges joined along a seam 1520 to form a tubular shell. The shell extends between a top edge 1522 and a bottom edge 1524 and defines a chamber 1526 through which the vessel 1502 may be interiorly disposed.

The rotatable label 1500 is substantially transparent and has arranged thereon limited indicia 1528. The limited indicia 1528 may include only one object, as shown in FIG. 15A, or, alternatively, embody several objects, which occupy a small amount of surface area on the rotatable label 1500.

Figure 15B:
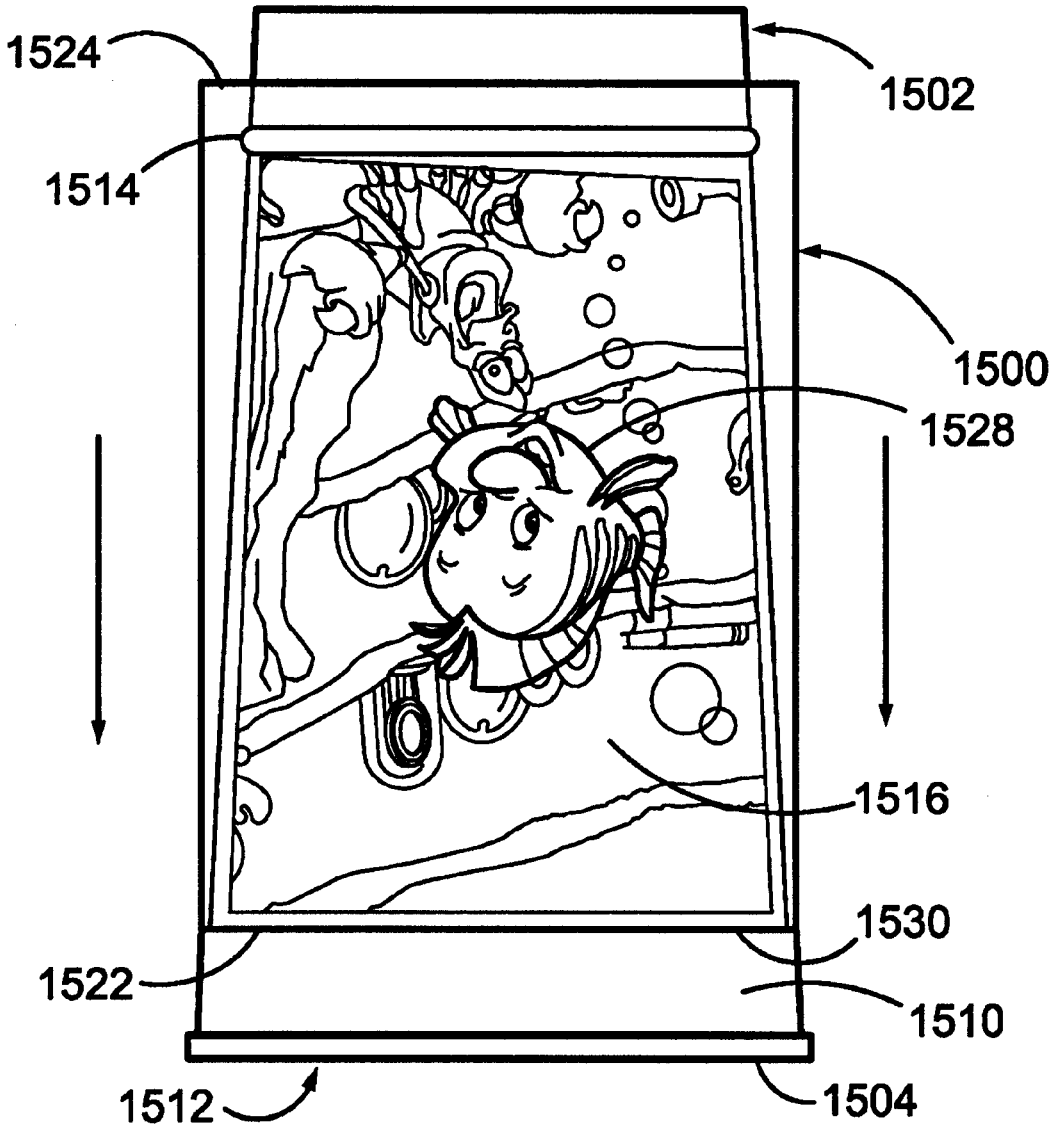
FIG. 15B is a front view of the rotatable label of FIG. 15A disposed about the drinking vessel of FIG. 15A.

FIG. 15B illustrates the rotatable label 1500 of FIG. 15A positioned about the drinking vessel 1502 prior to the heat application process. The diameter of the rotatable label 1500 is sized such that the rotatable label 1500 will stop longitudinally advancing along the length of the vessel 1502 when the top edge 1522 encounters a label stop location 1530. The label stop location 1530 inhibits further advancement because the diameter of the rotatable label 1500 is roughly equivalent to the diameter of the vessel 1502 at the label stop location 1530. Although FIG. 15A shows the label stop location 1530 on a lower margin of a drinking rim 1532, the label stop location 1530 may be positioned at other locations depending on the design of the rotatable label system.

The indicia 1528 of the rotatable label 1500 is now superimposed over the indicia 1516 disposed on the exterior surface 1518 of the vessel 1502. Following heat application to the shrinkwrap rotatable label 1500, the rotatable label 1500 will conform to the surface features and the surface contour 1514 of the vessel 1502. The subsequent rotation of the rotatable label 1500 relative to the vessel 1502 will cause the indicia 1528 on the rotatable label 1500 to move with respect to indicia 1516 disposed on the exterior surface 1518. In this specific example, the indicia 1528, the fish, will appear to "swim" along the underwater scene indicia 1516 of the exterior surface 1518, thus creating a three-dimensional visual effect.

The rotatable label 1500 is longitudinally maintained during rotation of the label 1500 relative to the vessel 1502 by various surface features. The surface contour 1514 inhibits vertical movement because the diameter of the rotatable label 1500 immediately adjacent to the surface contour 1514 is smaller than the diameter of the surface contour 1514, thereby preventing the adjacent rotatable label 1500 portions from moving over the surface contours 1514. Furthermore, the taper of the vessel 1502 prevents the upward movement of the rotatable label 1500 because the bottom edge 1524 is smaller than the diameter of the vessel 1502 immediately above the bottom edge 1524. Alternatively, the rotatable label 1500 and drinking vessel 1502 may incorporate other embodiments as described above.

The invention has been described with reference to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. A rotatable label system, comprising:

a drinking vessel having first indicia arranged about an exterior surface of said drinking vessel; and a rotatable label formed from a heat-shrinkable shell disposed about said drinking vessel and generally conforming thereto, said rotatable label having second indicia arranged thereon.

2. The rotatable label system of claim 1, further comprising a transparent window formed in said rotatable label to permit viewing of an underlying subset of said first indicia.

3. The rotatable label system of claim 1, wherein said drinking vessel is shaped to inhibit vertical displacement of said rotatable label relative to said drinking vessel.

4. The rotatable label system of claim 3, wherein said drinking vessel is tapered along its longitudinal length.

5. The rotatable label system of claim 3, wherein said drinking vessel is adapted with a surface contour extending circumferentially around said drinking vessel for prohibiting the longitudinal displacement of said rotatable label.

6. The rotatable label system of claim 5, wherein said surface contour comprises a raised rim.

7. The rotatable label system of claim 5, wherein said surface contour comprises a depression.

8. The rotatable label system of claim 1, wherein said first indicia is disposed on an inner label affixed to said drinking vessel.

9. The rotatable label system of claim 1, wherein said drinking vessel further comprises a gripping portion.

10. The rotatable label system of claim 1, wherein said drinking vessel further comprises a closure located on a top end of said drinking vessel.

11. The rotatable label system of claim 1, wherein said shell includes a perforation line extending circumferentially about said drinking vessel and detachably coupling a border to said rotatable label.

12. The rotatable label system of claim 11, wherein said border has an adhesive disposed thereon for affixing said border to said drinking vessel.

13. The rotatable label system of claim 12, further comprising a release tab coupled to said border, said release tab being configured to facilitate detachment of said border from said drinking vessel.

14. The rotatable label system of claim 1, wherein said rotatable label is substantially transparent and said second indicia is limited relative to the surface area on said rotatable label, said rotatable label creating a three-dimensional visual effect.

15. A method for constructing a rotatable label system on a drinking vessel, comprising the steps of:

providing a drinking vessel having first indicia arranged about an exterior surface of said drinking vessel;

inverting said drinking vessel;

providing a generally cylindrical rotatable label formed from a heat-shrinkable shell;

longitudinally disposing said shell about said inverted drinking vessel; and applying heat to said shell such that said shell generally conforms to said drinking vessel.

16. The method of claim 15, wherein the step of providing said drinking vessel further comprises providing a circumferential surface contour.

17. The method of claim 15, wherein the step of providing said shell further comprises providing a transparent window in said rotatable label to enable viewing of an underlying subset of said first indicia.

18. The method of claim 15, wherein the step of providing said shell further comprises providing at least one circumferential line of weakening coupling a border to said rotatable label.

19. The method of claim 18, wherein the step of providing at least one circumferential line of weakening further comprises disposing an adhesive to a rear surface of said border.

20. The method of claim 19, further comprising the step of providing a release tab to said border to facilitate detachment of said border from said drinking vessel.

21. The method of claim 15, wherein the step of longitudinally disposing further comprises adjusting a vertical position of said shell such that said first indicia is properly framed by said window.

22. The method of claim 15, further comprising the step of disposing a slip agent between an inner surface of the rotatable label and said drinking vessel to ensure that said rotatable label may be rotated relative to said drinking vessel.

* * * * *